US006536841B1

(12) United States Patent
Pearce et al.

(10) Patent No.: US 6,536,841 B1
(45) Date of Patent: Mar. 25, 2003

(54) SYNCHROTILT CHAIR

(75) Inventors: Peter J. Pearce, Woodland Hills, CA (US); Kurt R. Heidmann, Grand Rapids, MI (US); Robert J. Battey, Kentwood, MI (US); Dale M. Groendal, Jenison, MI (US); Bruce M. Smith, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/578,568

(22) Filed: May 25, 2000

Related U.S. Application Data

(63) Continuation-in-part of application No. 09/321,275, filed on May 27, 1999, now Pat. No. 6,412,869.

(51) Int. Cl.[7] ..... A47C 1/032

(52) U.S. Cl. ..... 297/316; 297/320; 297/300.4; 297/301.3; 297/296

(58) Field of Search ..... 297/300.4, 301.3, 297/452.29, 452.65, 452.54, 285, 295, 297, 296, 298, 316, 320, 321

(56) References Cited

U.S. PATENT DOCUMENTS

| | | | | |
|---|---|---|---|---|
| 141,318 | A | | 7/1873 | Buchanan |
| 1,104,615 | A | | 7/1914 | Braden |
| 1,945,018 | A | | 1/1934 | Boardman |
| 2,008,209 | A | | 7/1935 | Herold |
| 2,073,872 | A | | 3/1937 | Kliesrath |
| 2,087,253 | A | | 7/1937 | Herold |
| 2,087,254 | A | | 7/1937 | Herold |
| 2,153,327 | A | | 4/1939 | Herold |
| 2,228,719 | A | | 1/1941 | Bolens |
| 2,283,062 | A | | 5/1942 | Herold |
| 2,374,350 | A | | 4/1945 | Herold |
| 2,471,024 | A | | 5/1949 | Cramer |
| 2,783,822 | A | | 3/1957 | Hickman et al. |
| 3,111,343 | A | | 11/1963 | Pearson |
| 3,133,763 | A | | 5/1964 | Stoll et al. |
| 3,672,721 | A | | 6/1972 | Williams |
| 3,982,785 | A | | 9/1976 | Ambasz |
| 4,141,586 | A | | 2/1979 | Goldner et al. |
| 4,368,917 | A | | 1/1983 | Desanta |
| 4,495,740 | A | | 1/1985 | Sarrazin et al. |
| 4,575,150 | A | * | 3/1986 | Smith ..... 297/300.4 |
| 4,597,567 | A | | 7/1986 | Racca |

(List continued on next page.)

OTHER PUBLICATIONS

Discloses a webpage *www.theknollshop.com/sbd/knollshop/home.nsf,* showing a "Toledo" chair manufactured by Knoll Int'l. and made public prior to the filing date of the present application.

*Primary Examiner*—Anthony D. Barfield
(74) *Attorney, Agent, or Firm*—Price Heneveld Cooper Dewitt & Litton

(57) ABSTRACT

A synchrotilt chair includes a base, a back, a seat, and a link(s) pivoted to a rear of the base and to a bottom of the back to form a four-bar linkage arrangement. A spring arrangement includes a resilient member at one of the joints of each link to bias the link and in turn the back and seat toward an upright position, with the back and seat pivoting with a synchronous motion upon recline of the back. In one form, the chairs are nestable and stackable for dense storage. In another form, the chairs are desk-type pedestal chairs. Several of the structural support members of the chair are gas-assisted injection molding to form a hollow tubular shape that is lightweight, strong, and dimensionally-accurate. Armrests are pivoted to the back and have a shape configured to allow nested stacking while also providing excellent comfort, durability, and style. Also, the armrests are movable to remote storage positions to provide unobstructed side access to the seat of the chair.

21 Claims, 30 Drawing Sheets

U.S. PATENT DOCUMENTS

| | | | | | |
|---|---|---|---|---|---|
| 4,640,548 | A | | 2/1987 | Desanta | |
| 4,832,406 | A | * | 5/1989 | Adams et al. | 297/411.38 X |
| 4,852,943 | A | | 8/1989 | Roper | |
| 4,865,794 | A | | 9/1989 | Nakajima et al. | |
| 4,871,208 | A | | 10/1989 | Hodgdon | |
| 4,978,170 | A | | 12/1990 | Pelz et al. | |
| 5,116,556 | A | | 5/1992 | Danton | |
| 5,314,237 | A | | 5/1994 | Koepke et al. | |
| 5,649,740 | A | | 7/1997 | Hodgdon | |
| 5,806,931 | A | * | 9/1998 | Kogai | 297/301.3 |
| 6,056,361 | A | * | 2/2000 | Cvek | 297/296 X |
| 6,035,901 | A | | 3/2000 | Stumpf et al. | |
| 6,059,368 | A | | 5/2000 | Stumpf et al. | |

* cited by examiner

XLa
XLb
XLc
XLd
50A
51A
52A
52A'
52A"
53A
53A"
54A
55A
62A
63A
64A
65A
125A
126A
139A
165A
200
202
203
204
224'

50G
51G
52G
53G
54G
55G
62G
64G
65G
94'
125G
126G
165G
224'
240
241
241'
242
243
244
245
246
247
248
249
250
251
252
253
255
256
257
259
260
261
262
263
264
266
267
268
269
270
271
272
273
LVII B

SYNCHROTILT CHAIR

CROSS REFERENCES TO RELATED APPLICATION

This application is a continuation-in-part of application Ser. No. 09/321,275, filed May 27, 1999, entitled NESTABLE SYNCHROTILT CHAIR now U.S. Pat. No. 6,412,869.

BACKGROUND OF THE PRESENT INVENTION

The present invention relates to nestable chairs and pedestal supported chairs, and also relates to chairs having a reclineable back and a seat that moves with a synchronous motion upon recline of the back. The present invention further relates to chairs with components made from a few polymeric moldings that are easily assembled.

Modern consumers demand comfort and style in their chairs, but also demand cost-effective solutions given the highly competitive furniture industry. Further, the chairs must be durable and rugged, yet preferably should be mechanically simple, easily assembled, lightweight, and use low-cost components. Still further, many consumers want a modernistic appearance and one that takes advantage of modern materials, part-forming processes, and assembly techniques. Often consumers need chairs that are mobile and that can be stored in dense arrangements that minimize the storage space required. A problem is that these requirements create conflicting design criteria. For example, low-cost chairs tend to be less comfortable and less stylized. Chairs that are more comfortable, such as synchrotilt chairs, have more expensive components and greater assembly costs, are not stackable nor nestable for dense storage, and are usually too heavy to be lifted and/or stacked for storage.

Accordingly, a chair having the aforementioned advantages and features, and solving the aforementioned problems is desired.

SUMMARY OF THE INVENTION

In one aspect of the present invention, a chair includes a base subassembly having a vertically adjustable post, a seat pivotally supported atop the post at a seat pivot, and a reclineable back pivoted to the seat at a back pivot. A link has upwardly-directed sections pivoted to a lower portion of the back at a top link pivot and a downwardly-directed section pivoted to an upper rear portion of the base rearward of the post at a bottom link pivot. The base subassembly, the seat, the back, and the link are pivoted together to form a four-bar linkage arrangement with at least one of the pivots including a torsion biasing device for biasing the four-bar linkage arrangement to bias the back toward an upright position.

In another aspect of the present invention, a chair includes a base subassembly, a seat pivotally supported atop the base subassembly at a seat pivot, and a reclineable back pivoted to the seat at a back pivot. At least one link is pivoted to a lower portion of the back at a top link pivot and pivoted to an upper rear portion of the base rearward of the post at a bottom link pivot, the base, the seat, the back, and the link being pivoted together to form a four-bar linkage arrangement. Armrests are pivoted to one of the back, the seat and the base subassembly, each armrest being operably supported for movement to a use position generally above an associated edge of the seat for supporting a seated user's forearm, and for movement to a storage position that is remote from the associated edge of the seat, such that the edges of the seat are open and unobstructed for a seated user to enter the seat from a selected one of the edges of the seat.

In yet another aspect of the present invention, a chair includes a base, a seat, and a reclineable back operably connected together to form a seating unit providing synchronous motion of the seat upon recline of the back. Armrests are pivoted to the seating unit at armrest pivots for movement between a horizontal use position where the armrests extend forward of the back and a vertical use position where the armrests extend vertically from the armrest pivots, the armrests when in the storage positions being located substantially behind a front surface of a lumbar area of the back.

In another aspect of the present invention, a chair includes a base subassembly, a seat pivotally supported atop the base subassembly at a seat pivot, a reclineable back pivoted to the seat at a back pivot, and a link having upwardly-directed sections pivoted to a lower portion of the back at a top link pivot and a downwardly-directed section pivoted to an upper rear portion of the base rearward of the post at a bottom link pivot. The base subassembly, the seat, the back, and the link are pivoted together to form a four-bar linkage arrangement with at least one of the base subassembly, the seat, the back and the link having a tubular structural section with a hollow elongated core.

In yet another aspect of the present invention, a base for a chair includes structural side members each including front and rear legs, and a structural transverse member rigidly interconnecting the structural side members. At least one of the structural members includes an elongated hollow closed section with a longitudinally-extending internal cavity that is non-uniform in cross section at different longitudinal locations, the close section being formed of molded plastic material capable of being molded by a gas-assisted injection molding process.

In still another aspect of the present invention, a chair component for supporting a seated user, such as is usable to support a seated user's back, buttocks or forearms, includes a relatively flat one-piece component shaped to support a body part of a seated user. The component includes a relatively stiff perimeter section defining a ring area and a sheet-like flexible panel filling the ring area and extending between different portions of the perimeter section. The perimeter section has a tubular construction and includes a longitudinally-extending internal cavity that extends around the perimeter section to provide a high strength to weight ratio. The flexible panel is integrally formed of the same material of the perimeter section but is relatively thin and further includes slots arranged to provide flexure to the flexible panel for improved comfort to a seated user.

These and other features, objects, and advantages of the present invention will become apparent to a person of ordinary skill upon reading the following description and claims together with reference to the accompanying drawings.

DETAILED DESCRIPTION OF PREFERRED EMBODIMENT

Figure 6A:
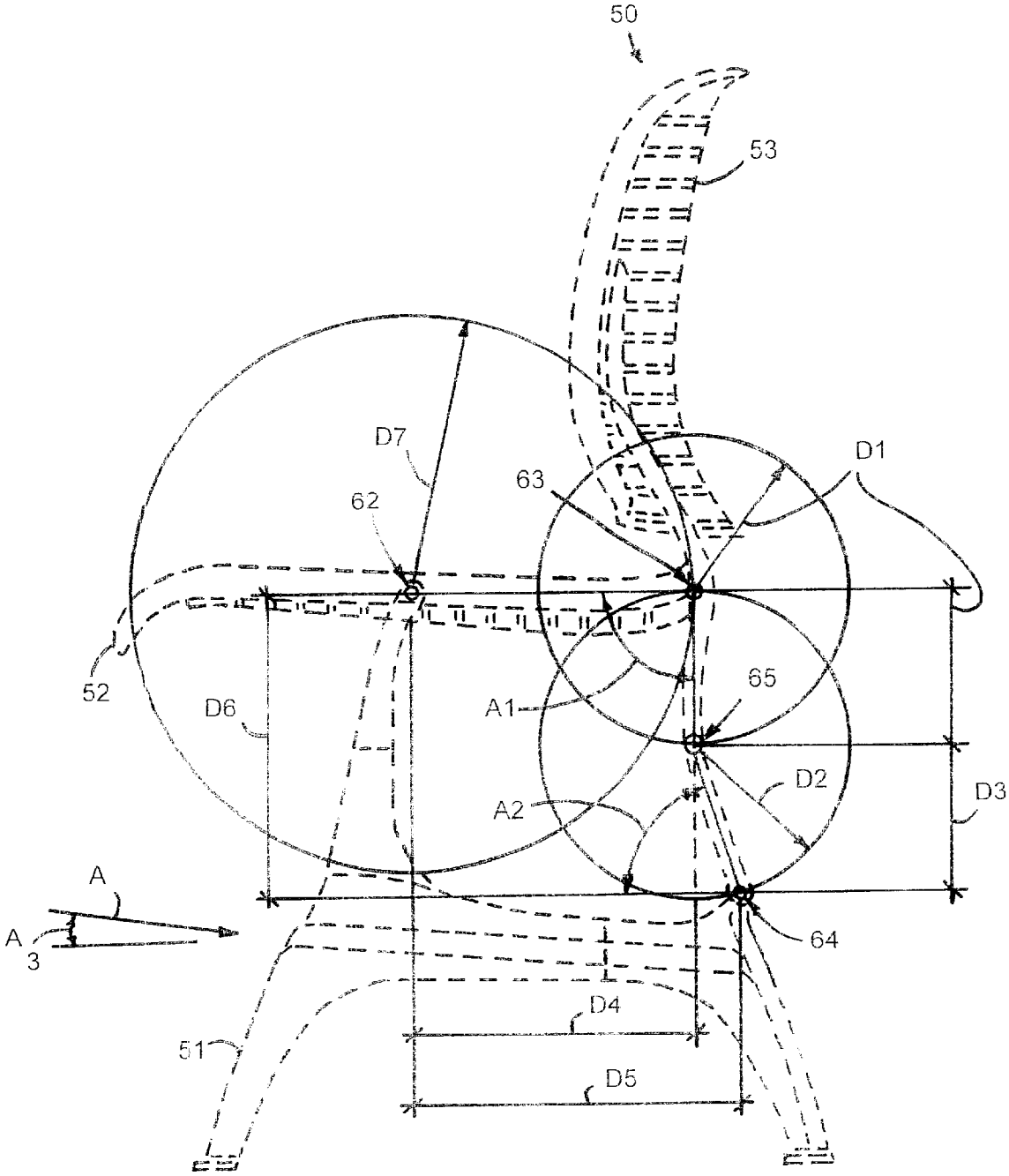
FIG. 6A is a side view similar to FIG. 6, but showing dimensional relationships.
Figure 11:
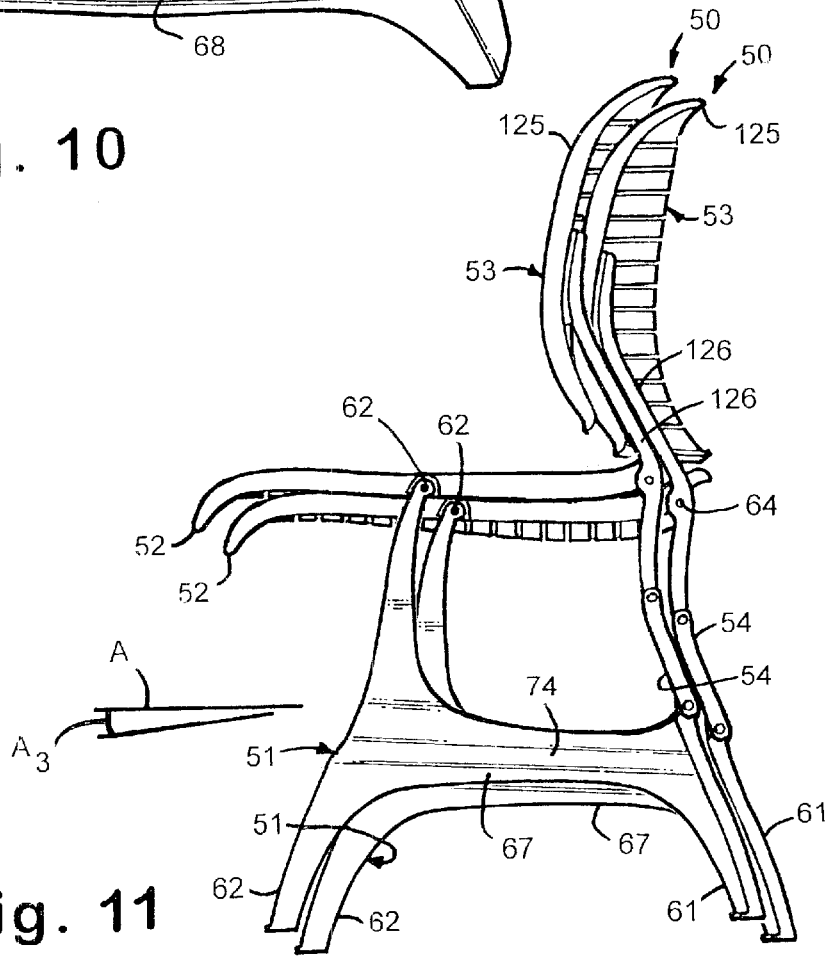
FIG. 11 is a side view of a pair of the chairs shown in FIG. 1 nested together in a stacked arrangement
Figures 12, 13, 14, 15:
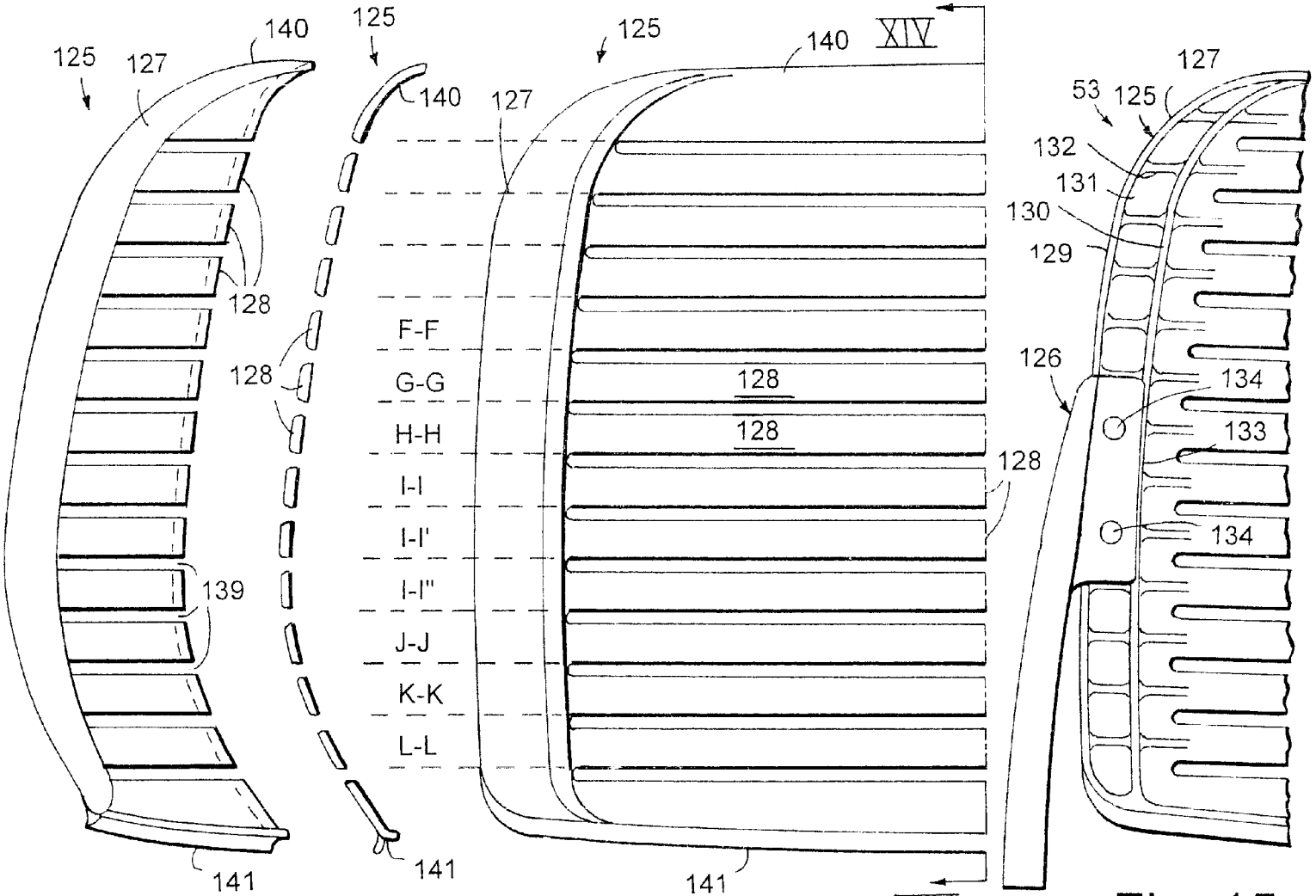
FIG. 12 is a side view of the back shell of the back shown in FIG. 1.
FIG. 13 is a front view of half of the back shown in FIG. 12.
FIG. 14 is a cross-sectional view taken along the line XIV—XIV in FIG. 13.
FIG. 15 is a fragmentary rear view of the back shown in FIG. 1, including the fixed lever attached to the back shell.

A chair 50 (FIG. 1) embodying the present invention includes a base 51, a seat 52 pivoted to the base 51 at a seat-to-base first pivot 62, and a back 53 pivoted to the seat 52 at a back-to-seat second pivot 63. A pair of upwardly extending semi-parallel links 54 is pivoted to a rear of the base 51 at a link-to-base third pivot 64 and to a bottom of the back 53 at a link-to-back fourth pivot 65 to form a four-bar linkage arrangement with the seat 52 and the back 53. A spring arrangement includes leaf springs 55 that extend past third pivot 64 between each link 54 and the base 51 to bias the links 54 and in turn bias the back 53 and seat 52 toward an upright position. The back 53 and seat 52 pivot with a synchronous motion upon recline of the back 53. Advantageously, the base 51, the back 53, the seat 52, and the links 54 are shaped to nest against identical chairs along a stacking direction "A" (FIG. 11) to form a densely stacked arrangement for compact storage. The "stacking" direction "A" extends at a slight angle A3 to horizontal, as shown in FIGS. 6A and 11, but of course its orientation will change if the chairs 20 are stored on a wheeled cart that provides a different storage position. Further, the components 51–54 are lightweight and one-piece or "few-piece" constructions that provide low cost and that facilitate quick assembly.

The illustrated base 51 (FIG. 1) is a one-piece injection-molded part molded from reinforced polymeric material, e.g., a glass reinforced polymer. It is specifically contemplated that the base can be manufactured from other materials, such as tubular metal, aluminum castings, carbon fiber, and the like. The illustrated base 51 has a total weight of only about three pounds, yet it is surprisingly rigid and of sturdy construction. The base 51 has a distinctive rearwardly facing, horizontal U-shaped mid-frame structure 57 (FIG. 7) defining a plurality of corners, and further has pairs of front and rear up legs 58 and 59 and pairs of front and rear down legs 60 and 61 extending upwardly and downwardly, respectively, from each of the corners. The down legs 60 and 61 are configured to stably engage a floor surface. The front up legs 58 are configured to stably pivotally support the seat 52, and the rear up legs 59 are configured to stably pivotally support the bottom of the links 54.

More specifically, the mid-frame structure 57 (FIG. 7) includes a pair of side beam sections 67 and a front beam section 68 forming the U-shape of the mid-frame structure 57. The side beam sections 67 (FIGS. 7F–7H) have cross sections that mirror each other. The beam sections 67 include an approximately vertical longitudinal wall 69 and a longitudinal/horizontal stiffening rib 70. Angled and vertical webs 71 and 72, respectively, stabilize the wall 69 and the rib 70 to form a rigid beam having a high strength-to-weight ratio. The thickness of wall 69, rib 70, and webs 71 and 72 are all about equal to facilitate the molding process and to minimize distortion upon cooling of the base 51 during molding. The vertical/longitudinal wall 69 includes an approximately vertical top portion 73, a significantly angled mid portion 74, and a slightly angled bottom portion 75. The side beam sections 67 are non-parallel, but instead are angled laterally/outwardly toward their rear end to form an open structure or "throat" adapted to receive an identical chair base 51 in a dense stacked arrangement for storing the chairs. The angled mid portion 74 includes an outer surface angled to form a track or support rail that slidably engages a mating portion on horizontal rib 70 and web 72 on a second chair 50 being nested against a first chair 50 (see FIG. 11) to support at least a portion of a weight of the second chair.

The front beam section 68 (FIG. 7L) includes a longitudinal/vertical wall 76 and several longitudinal/horizontal stiffening ribs 77–80 that extend inwardly from the wall 76. Vertical webs 81 and 83 and angled webs 82 stabilize the wall 76 and the ribs 77–80 to form a rigid beam having a high strength-to-weight ratio. The thickness of wall 76, ribs 77–80, and webs 81–83 are all about equal to facilitate the molding process and to minimize distortion upon cooling of the base 51. The second highest rib 78 is elongated, and includes a rear section 78' that extends approximately parallel the highest rib 77. This arrangement and the shape of wall 76 cause the rear section 78' of the second highest rib 78 of a first chair 50 to rest on the highest rib 77 of a nested second chair 50 (see FIG. 7M).

Front down legs 60 (FIGS. 7A and 7B) each have a C-shaped cross section with an L-shaped outer side wall 85, an inner stiffening rib 86, and webs 87 for stabilizing the wall 85 and the rib 86. A bottom one of the webs 87 forms a platform for stably engaging a floor surface. Rear down legs 61 (FIGS. 7I and 7J) each have a shape similar to front down legs 60. Specifically, the front down legs 60 each include a C-shaped cross section with an outer L-shaped side wall 88, an inner stiffening rib 89, and webs 90 for stabilizing the wall 88 and the rib 89. A bottom one of the webs 90 forms a platform for stably engaging a floor surface.

Figure 28:
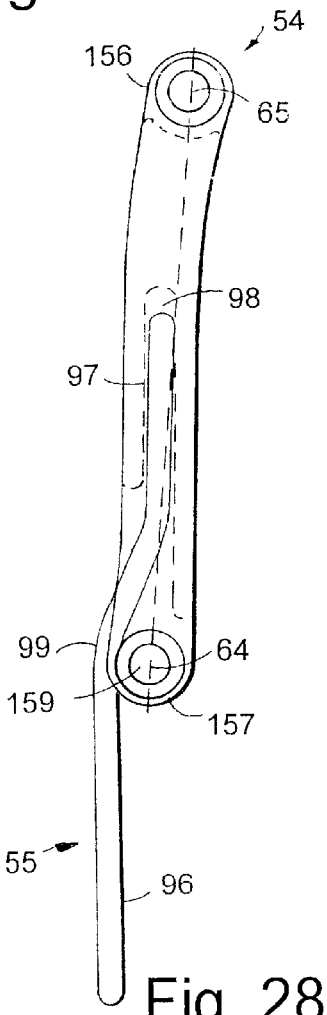
FIG. 28 is a side view of an assembly of the link shown in FIG. 23 and the spring shown in FIG. 26.
Figure 26:
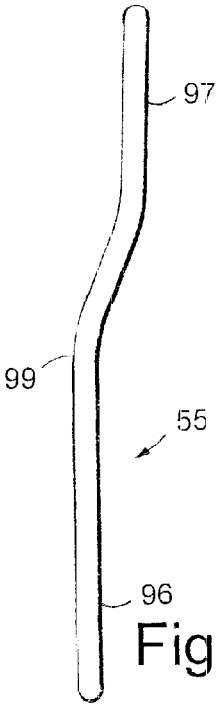
FIG. 26 and 27 are side and front views of the spring shown in FIG. 5.
Figure 27:
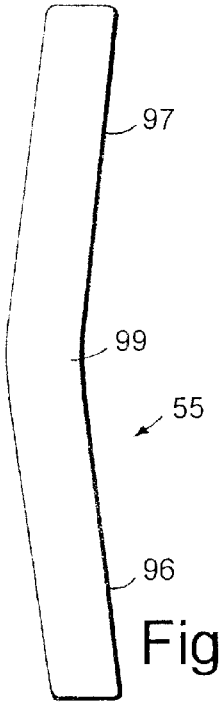

Atop each rear down leg 61 (FIG. 7) is an enlarged top section 59 (also called a "rear up leg" herein) having a hole 93 for receiving a pivot pin 94 to form the bottom link-to-base pivot 64. Further, a pocket or recess 95 extends longitudinally downwardly into a top section 61' of the rear down legs 61 at a location spaced slightly forward of the hole 93. The pocket 95 is configured to closely receive a lower half 96 (FIG. 28) of the spring 55. The spring 55 further includes an upper half 97 that is adapted to engage a pocket 98 in the link 54, and an intermediate section 99 that connects the upper and lower halves 96 and 97 in an offset relationship so that the halves 96 and 97 are oriented to engage the respective pockets 95 and 98. Further, the offset intermediate section 99 orients the halves 96 and 97 in a non-linear arrangement so that the spring 97 will clear pivot 94.

Front up legs 58 (FIGS. 7C–7E) each have a C-shaped cross section with an L-shaped outer side wall 101, inner stiffening ribs 102 and 102', and webs 103' for stabilizing the wall 101 and the ribs 102 and 102'. An enlargement 103 (FIG. 7) on a top end of the front up legs 58 includes a hole 104 for receiving a pivot pin 105 to form the seat-to-base pivot 62. The front up legs 58 are angled forwardly and outwardly to mate with the seat 52 (FIG. 8).

Figure 2:
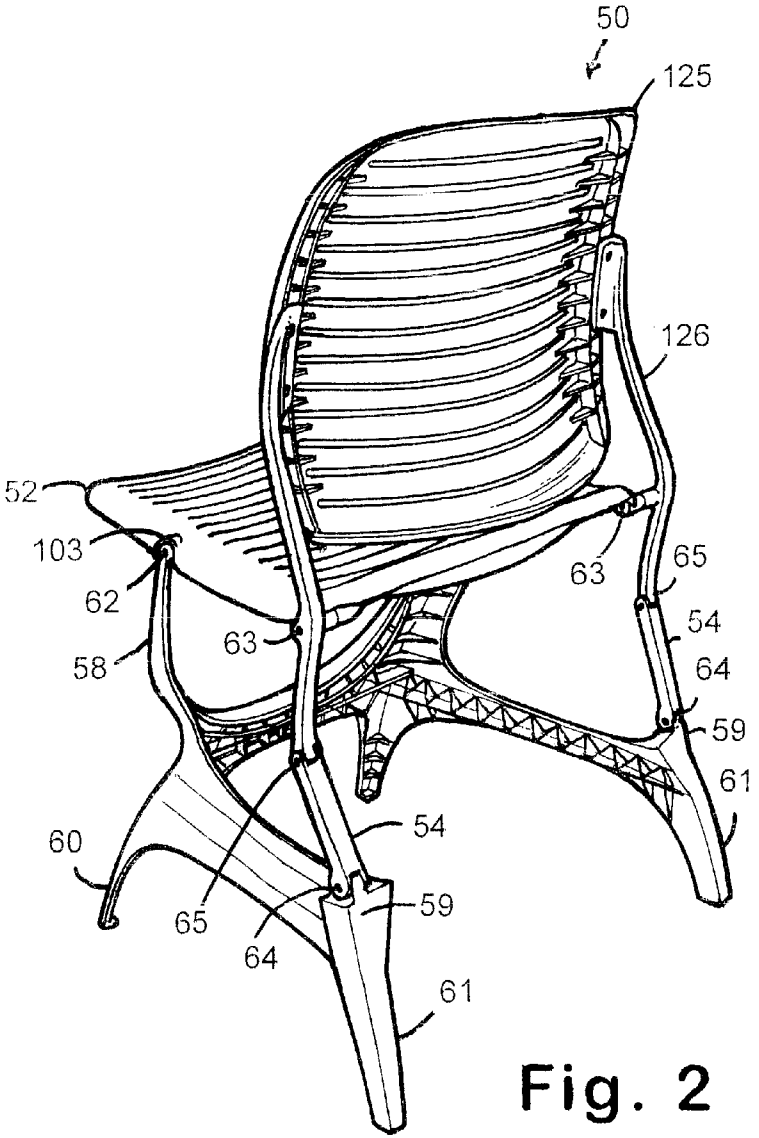
FIG. 1 and 2 are front and rear perspective views, respectively, of a chair embodying the present invention.
Figure 1:
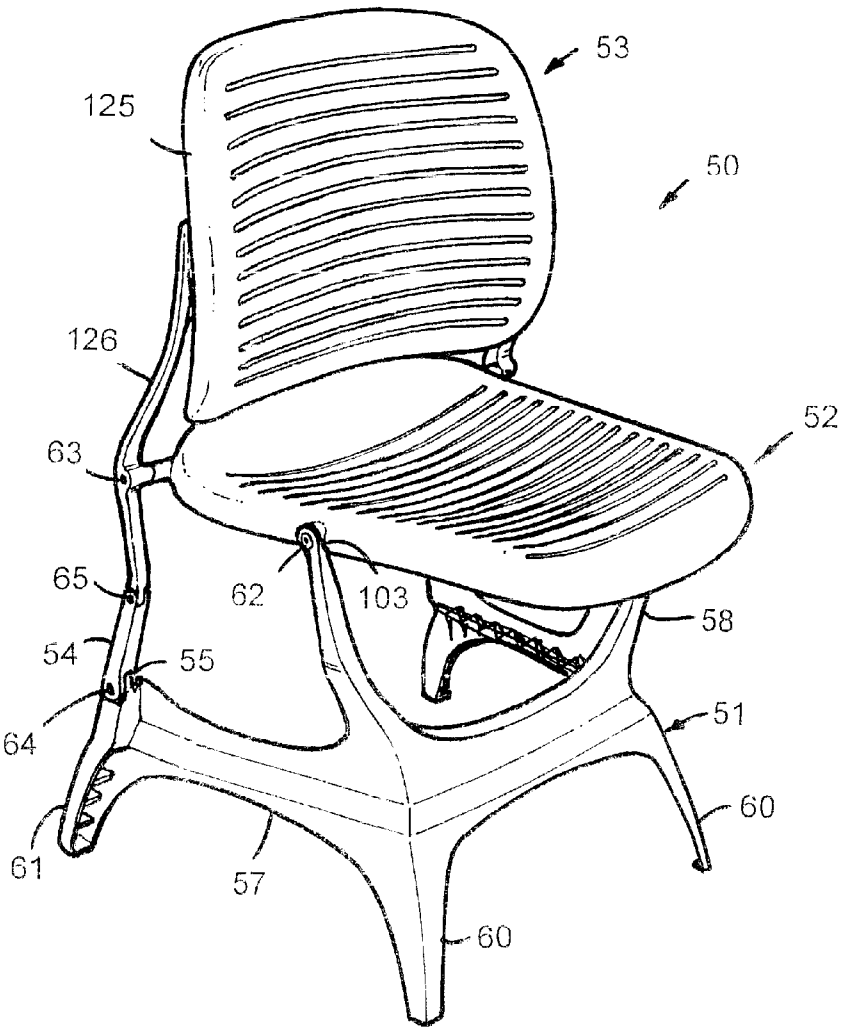
Figure 4:
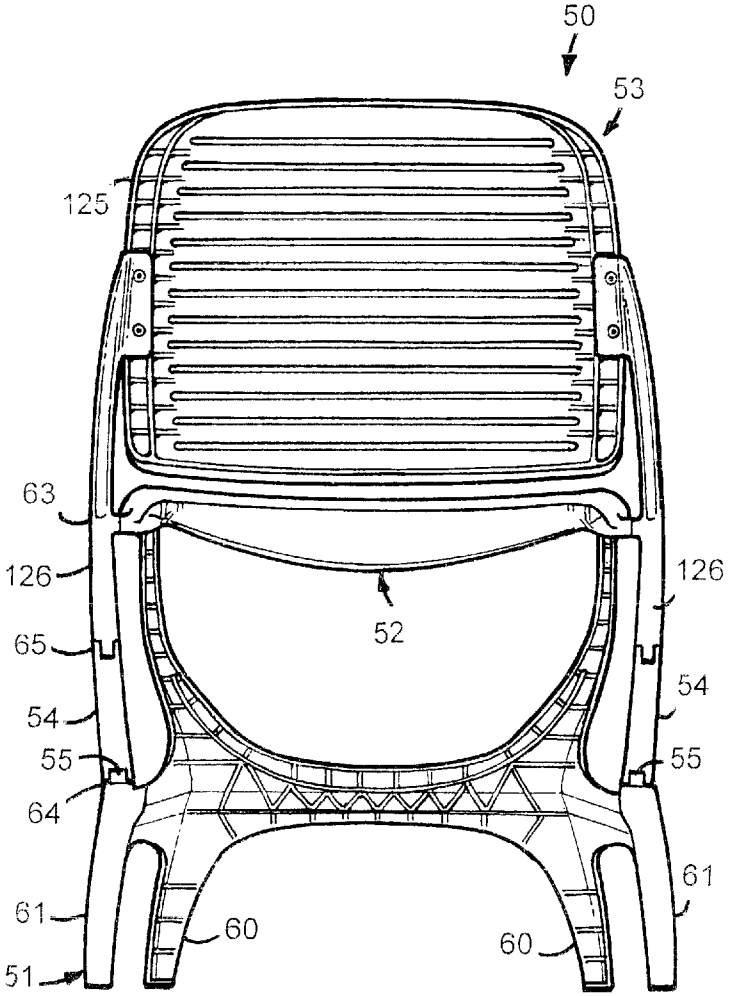
FIGS. 3–4A are front, rear, and top views of the chair shown in FIG. 1.

It is noted that the outer surface of the base 51 is contoured and characteristically absent of ribs, such that it provides an attractive and smooth appearance (see FIGS. 1 and 2). Concurrently, the various ribs and webs extend inwardly so that they are generally hidden from view or in a location where they are not easily seen or noticed. Nonetheless, the base 51 is configured to be injection molded as a one-piece component using existing molding technology and apparatus. It will be apparent to those skilled in the art that the present base 51 can be strengthened by substituting different polymeric materials, and/or can be strengthened by increasing or varying the amount and types of reinforcing materials used. Further, it is to be understood that the base 51 can be strengthened by increasing wall thickness, the number and locations of ribs and webs, and by other ways in the art of molding polymeric components.

Figure 20:
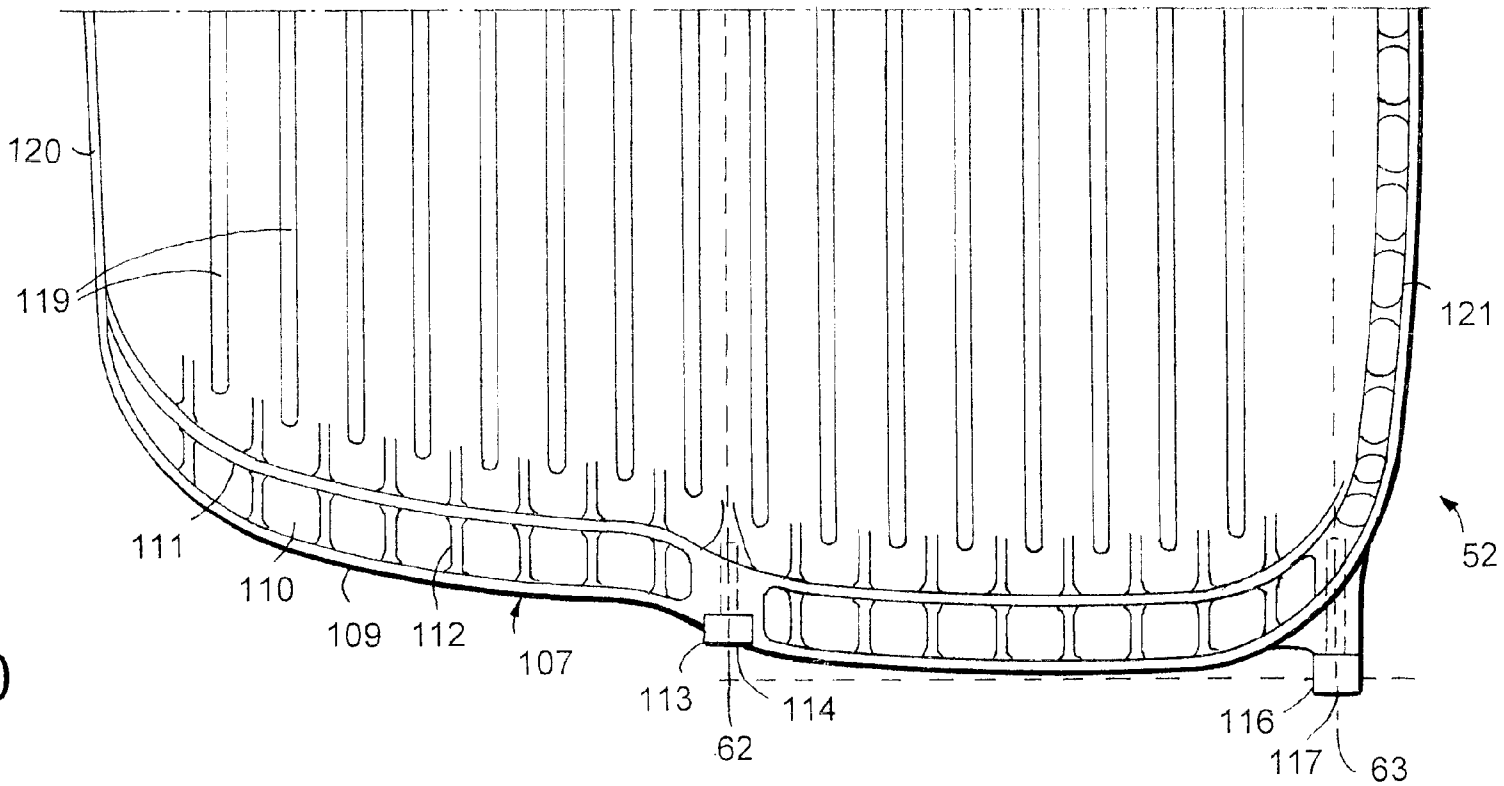
Figure 22A:
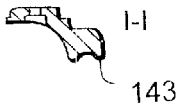
FIGS. 22A–22G are cross-sectional views taken along the lines II–TT, respectively, in FIG. 21.
Figure 22B:
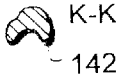
Figure 22C:
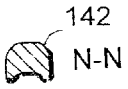
Figure 22D:
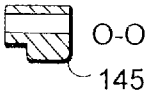
Figure 22E:
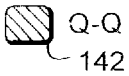
Figure 22F:
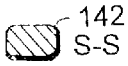
Figure 22G:
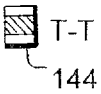

The seat 52 (FIGS. 17–20) is a one-piece molding that includes an integral seat frame 107 that extends around a perimeter of the seat 52, and a plurality of bands 108 that extend horizontally between opposing sides of the seat frame 107. The seat frame 107 has an inverted U-shaped cross section that extends around a perimeter of the seat 52. The inverted U-shaped cross section of seat frame 107 (FIG. 20) includes outer, top, and inner walls 109–111 with webs 112 spaced along the perimeter to stiffen the walls 109–111. A pair of enlargements 113 extends from the front up legs 58 of the base 51. The enlargements 113 are located midway along sides of the seat frame 107 and each include a hole 114 for receiving one of the pivot pins to form the seat-to-base pivot 62. A second pair of enlargements 116 is located at a rear of the seat 52 at a rear corner of the seat frame 107. These enlargements 116 include holes 117 for receiving another pivot pin to form the back-to-seat pivot 63. The bands 108 of seat 52 are separated by slots 119 that extend horizontally across the seat 52 between the inner walls 111. The spacing of the slots 119 and the thickness and shape of the bands 108 are chosen to provide an optimal resilient support to a seated user, while still maintaining the structure needed to stabilize the seat frame 107. A front section 120 of the seat frame 107 curves downwardly to comfortably support the knees and thighs of a seated user, while a rear section 121 of the seat frame 107 curves upwardly to comfortably matingly support buttocks of a seated user. In the illustrated seat frame 107, the inner wall 111 and the webs 112 continue around the sides and rear of the seat frame 107, but are discontinued across the front section 120 since the curvature of the front section 120 provides sufficient structure to the seat 52. It is contemplated that different rib arrangements and wall and rib arrangements are possible, and the scope of the present invention is believed to include the same.

Figure 16:
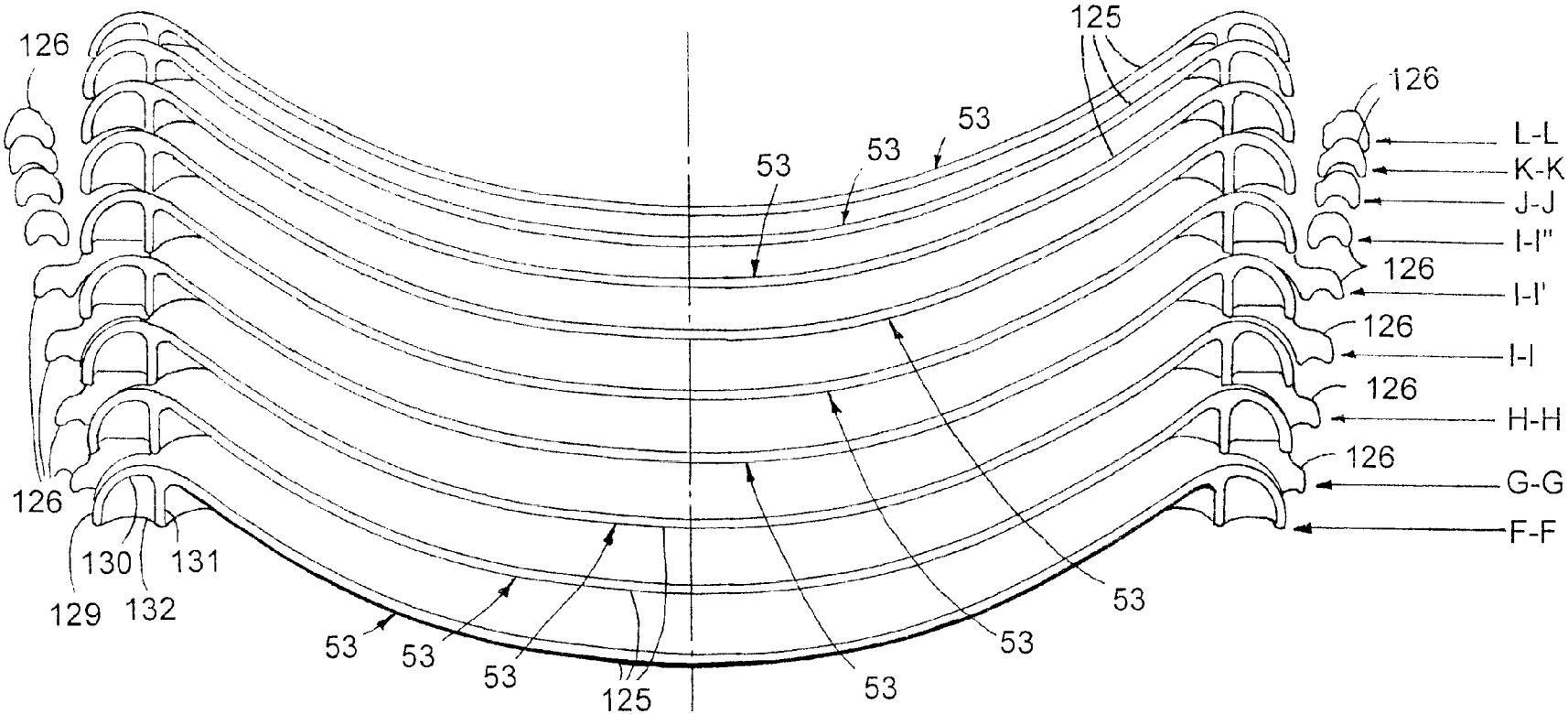
FIG. 16 is a horizontal cross section through nine chairs stacked together, with the location of the cross section in each successive stacked chair being shown by cross section lines FF–LL in FIG. 13.
Figure 17:
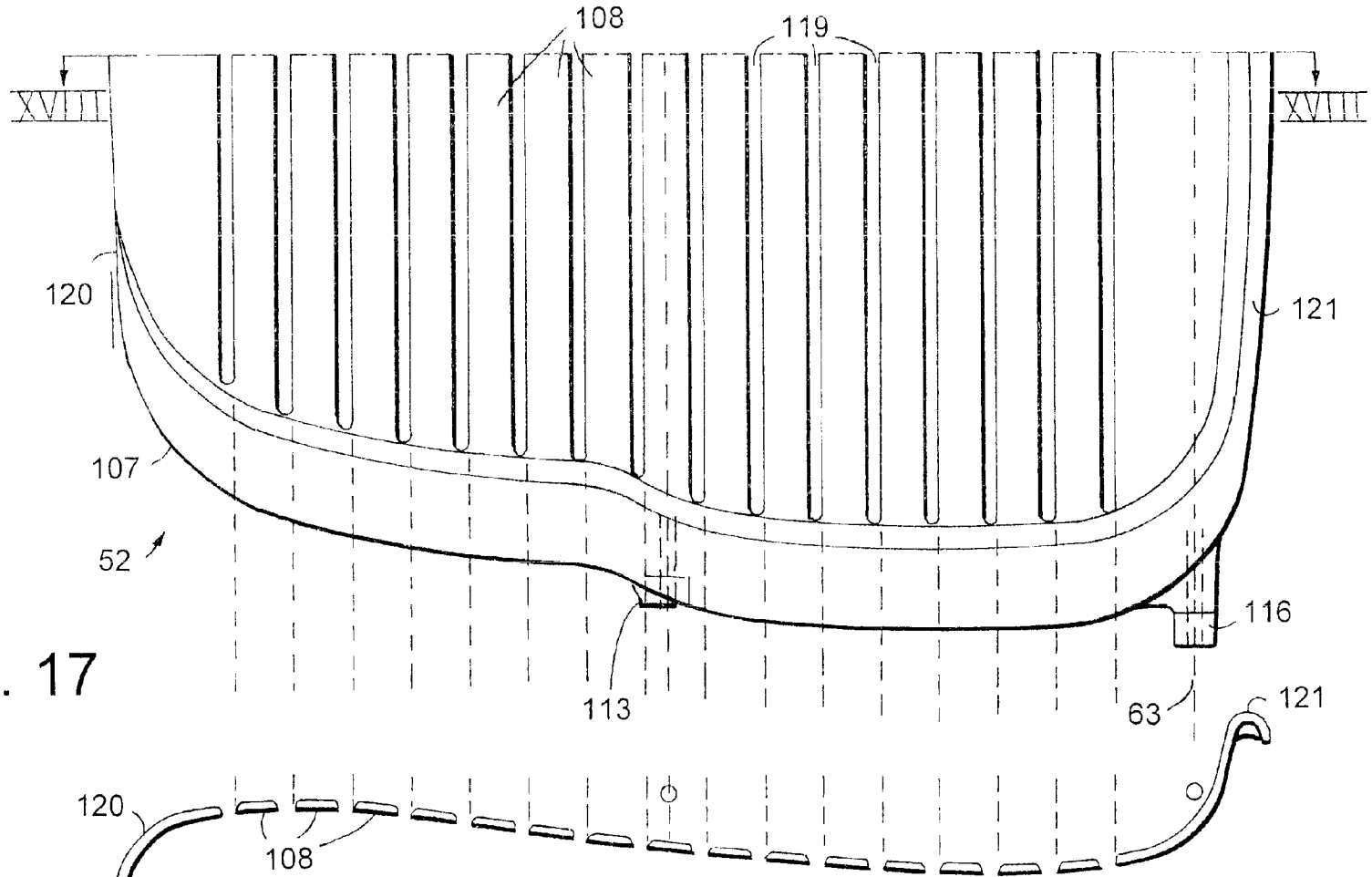
FIG. 17 is a plan view of half of the seat shown in FIG. 1.
Figure 18:
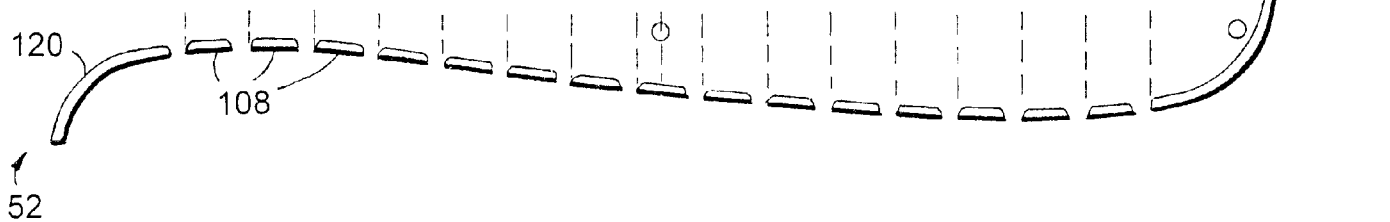
FIG. 18 is a cross-sectional view taken along the line XVIII—XVIII in FIG. 17.
Figure 19:
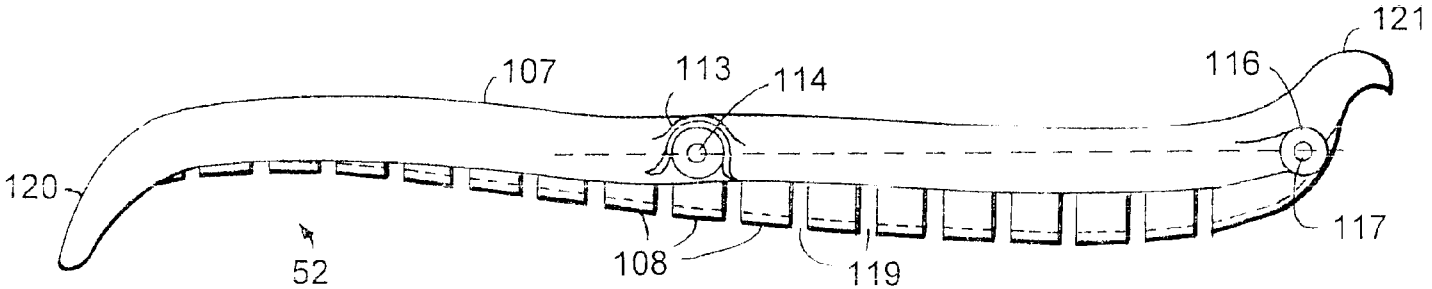
FIGS. 19 and 20 are side and bottom views of the seat shown in FIG. 17.

The back 53 (FIGS. 12–16) includes a back shell 125 and fixed levers 126 secured to the back shell 125. The back shell 125 is a one-piece molding that includes an integral back frame 127 that extends around a perimeter of the back shell 125, and a plurality of bands 128 that extend horizontally across sides of the back frame 127. The back frame 127 (FIG. 16) has an inverted U-shaped cross section that includes outer, top, and inner walls 129–131 with webs 132 spaced along the perimeter on its vertical sides to stiffen the walls 129–131. A pair of areas 133 located midway along the vertical sides of the back frame 127 each include a pair of holes for receiving screws 134 or other mechanical fasteners to fixedly attach the fixed levers 126 to the back shell 125. It is contemplated that other means can be used to attach the levers 126 to the back shell 125, such as adhesives, polymeric welding processes, and the like. The bands 128 are separated by slots 139 that extend horizontally across the back shell 125 between the inner walls 131. The spacing of the slots 139 and the thickness and shape of the bands 128 are chosen to provide an optimal resilient support to a seated user, while still maintaining the structure needed to stabilize the back frame 127. A top section 140 of the back frame 127 curves rearwardly to comfortably support the upper back and thoracic area of a seated user, while a lower section 141 of the back frame 127 also curves rearwardly to comfortably matingly support a lower back and lumbar area of a seated user. In the illustrated back frame 127, the inner wall 131 and the webs 132 continue vertically along the sides of the back frame 127, but are discontinued across the top and bottom of the back frame 127 since the curvature of the front section 140 provides sufficient structure to the back 53. It is contemplated that different rib arrangements and wall and rib arrangements are possible and that they will still be within a scope of the present invention.

Figure 21:
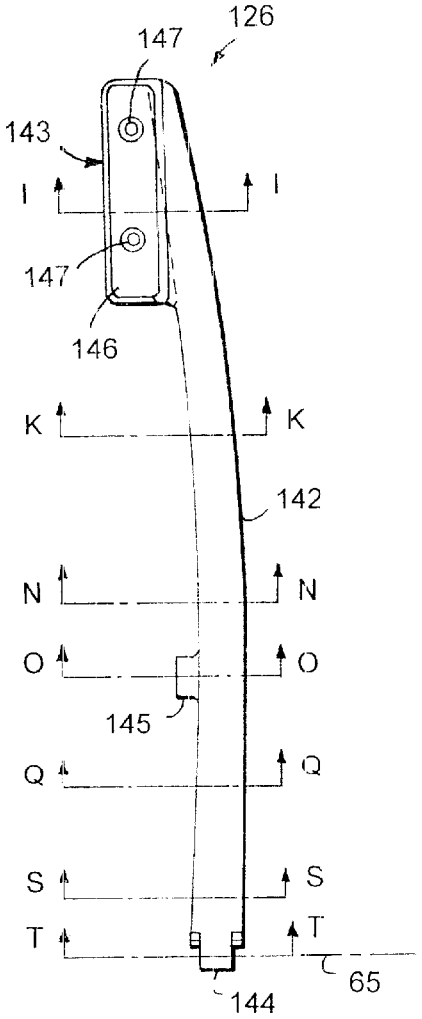
FIGS. 21 and 22 are front and side views of the fixed lever shown in FIGS. 4, 5, 15, and 16.
Figure 22:
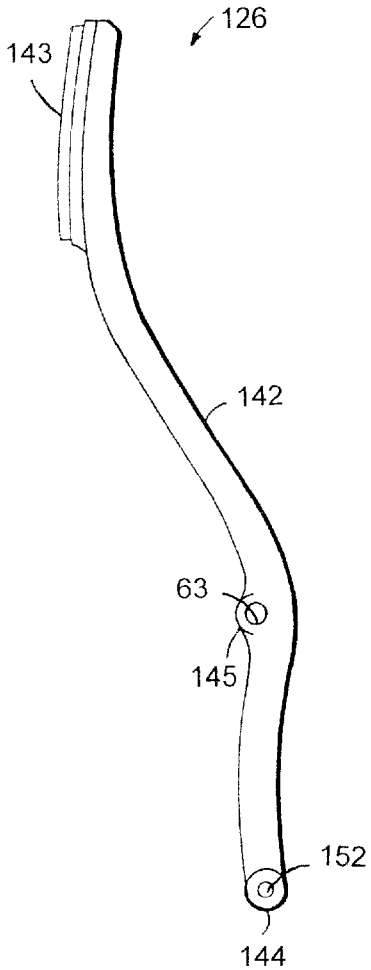
Figure 25:
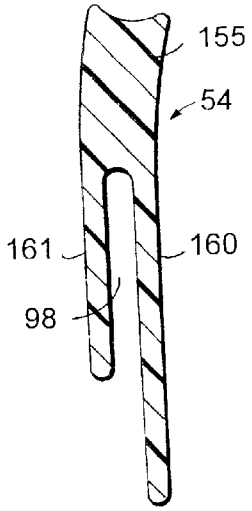
FIG. 25 is a fragmentary cross-sectional view taken along the line XXV—XXV in FIG. 24.

The levers 126 (FIGS. 21 and 22) are elongated one-piece molded components having an elongated body 142, with a back shell engaging top attachment section 143 at an upper end, a lower pivot-forming enlargement 144 at a bottom end, and an upper second pivot-forming enlargement 145 located in an intermediate position. The attachment section 143 includes a protruding face 146 shaped to be closely received between the outer and inner walls 129 and 131 and against the area 133 therebetween on the back frame 127. Holes 147 align with holes in the back frame 127, and screws 134 are extended through the holes 147 and are threadably secured by engagement of the, screws into the attachment section 143 (see FIG. 16, section HH) or are secured in place by washers and nuts. The upper pivot-forming enlargement 145 includes a hole 150 for receiving a pivot pin 151 to form the back-to-seat pivot 63. The lower pivot-forming structure 144 includes a hole 152 for receiving a pivot pin 153 for forming the upper link-to-base pivot 65. link 54 (FIGS. 23–28 and 23A–23E) includes a dog-bone-shaped body 155 having spaced top flanges 156 and spaced bottom flanges 157. The top flanges 156 are shaped to receive the bottom pivot-forming enlargement 144 on the lever 126. The top flanges 156 include aligned holes 158 that align with the hole 152 in lever 126 to receive a pivot pin. The bottom flanges 157 of link 54 are shaped to receive therebetween the top pivot-forming enlargement 59 of the base 51. Specifically, the bottom flanges 157 include aligned holes 159 that align with the hole 93 in the enlargement 59 to receive the pivot pin 94. The body 155 (FIG. 25) includes a center section with flanges 160 and 161 that define the pocket 98 for receiving the upper half 96 of the spring 55. Side flanges; 162 and 163 capture the spring 55 and prevent the spring from slipping sideways out of the pocket 98. As noted previously, the pocket 98 allows the spring 55, which is a leaf spring, to be extended around the link-to-base pivot 65. Further, the pocket 98 retains and orients the leaf spring 55 in association with pocket 95 of the base 51 so that it will not accidentally slip out of or work its way out of the pocket 98, but the pocket 98 is further long enough to allow some slippage of spring 55 as the back 53 is reclined, due to the offset position of spring 55 relative to the axis 64. Optimally, the link 54 is selected to position axes 63 to 65 and axes 65 to 64 about the same distance apart. This provides a good synchronous motion by the seat 52 and back 53 upon recline.

Figure 5:
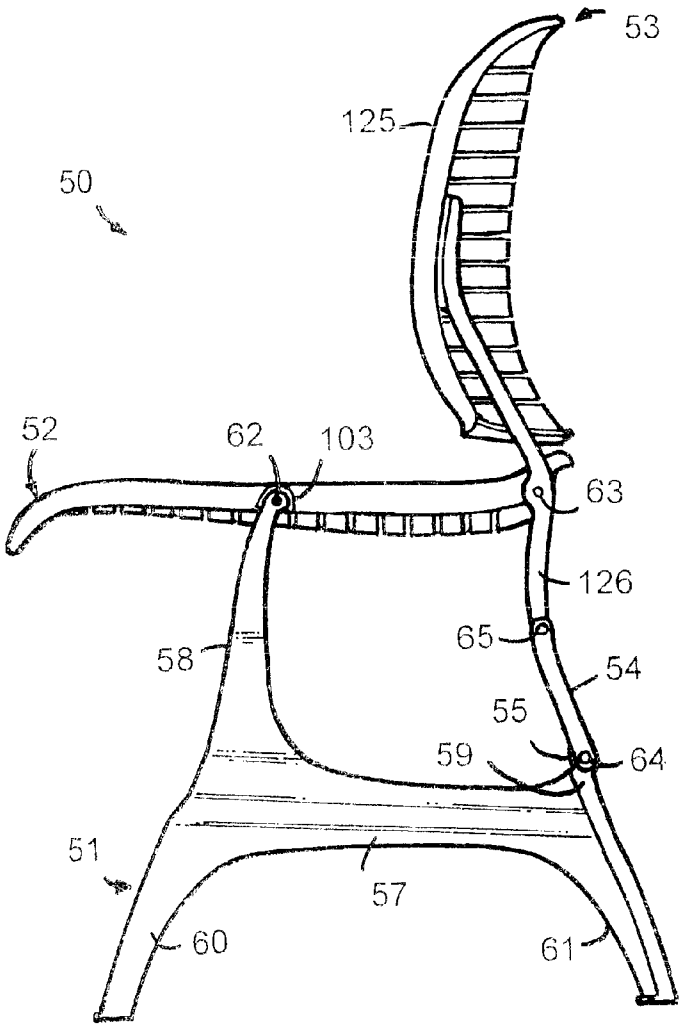

The shape and spring constant of the spring 55 will vary depending upon the application, the design criteria, and its relation to the pivot at which it is used. It is contemplated that the spring 55 can be located at any one of the pivots 62–65, and that a scope of the present invention includes different springs other than only leaf springs. The upward orientation of the spring 55 (see FIG. 5) significantly adds to the stability of the chair 50 in its rest position or upright position, and also reduces the need for a very strong spring 55. It is contemplated that in the present chair 50, the spring 55 will only need to have a surprisingly low spring constant, and will be made from a section of glass reinforced polyester material having a thickness of about 0.200 inches.

The orientation and shape of the present components and the distance between pivots 62–65 lead to a particularly functional and comfortable chair 20. The specific dimensions of the preferred chair 20 are provided to be very clear about their relationships, but it is noted that the ratios and relationships can be changed to achieve desired changes in function, comfort, or appearance of a chair. The illustrated dimensions (FIG. 6A) are as follows: D1=5.0 inches; D2=5.0 inches; D3=4.8 inches; D4=9.0 inches; D5=10.4 inches; D6=9.8 inches; D7=9.0 inches; angle A1=90 degrees; and angle A2=73.3 degrees. These dimensions and relationships result in what I call a "meta-stable" behavior, which provides an almost perfect counter balancing effect. This enables the sitter to spontaneously control the pitch of the chair (seat and back) as well as actually rock in the chair. This rocking ability is considered an important ergonomic benefit since rocking actually stimulates circulation in the body and exercises the muscles.

The unique behavior of this chair is attributable to the geometry of its linkage and the springs. The synchronous relationship between the seat and the back is an important aspect of this meta-stable behavior, as are the specific locations of the various pivot points which define the geometry. The drawing of FIG. 6A shows the chair in an unloaded position. You will note that link 54 (which I call the pivot link) has a forward slope of 73.3 degrees (or about 16.7 degrees from vertical). This locates pivot 65 "over center" relative to pivot 64. This, of course, means that when loaded, pivot 65 will rotate towards the front of the chair. The "over center" horizontal displacement in unloaded position between pivots 65 and 64 is about 1.4 inches. Note that pivot 63 is vertically positioned over pivot 65.

Figure 29:
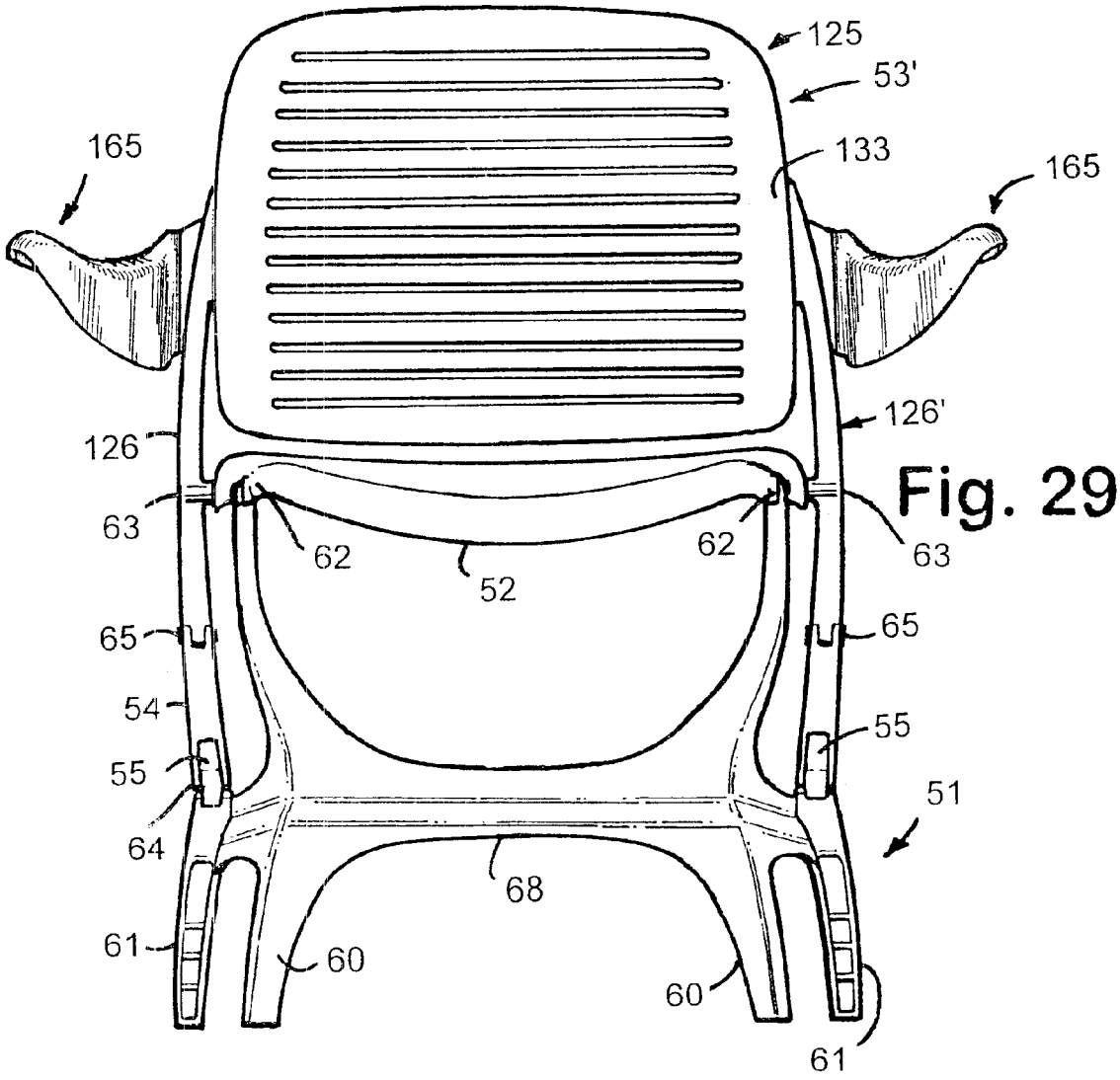
FIGS. 29 and 30 are front and side views of a chair similar to the chair shown in FIGS. 3 and 5, but including armrests.
Figure 31:
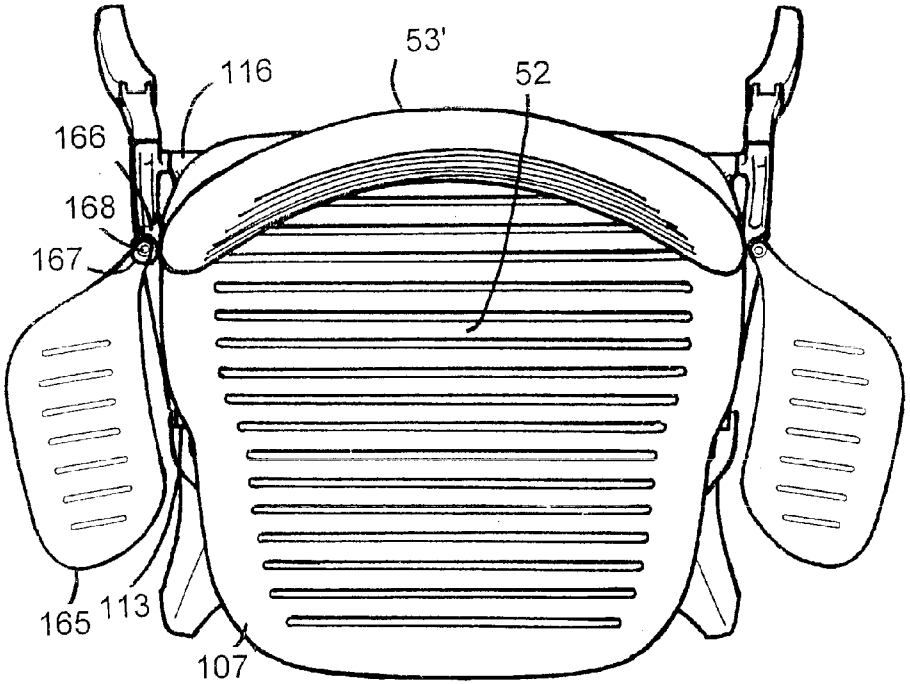
FIG. 31 is a top fragmentary view of the chair shown in FIG. 30, with rotated positions of the armrests being shown in phantom.
Figure 30:
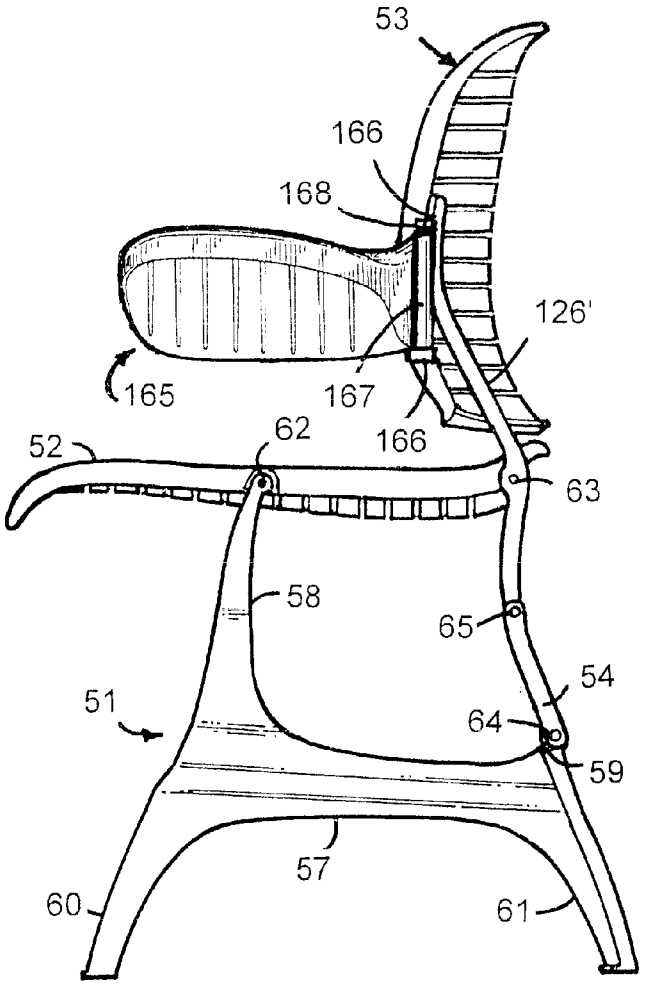
Figure 32:
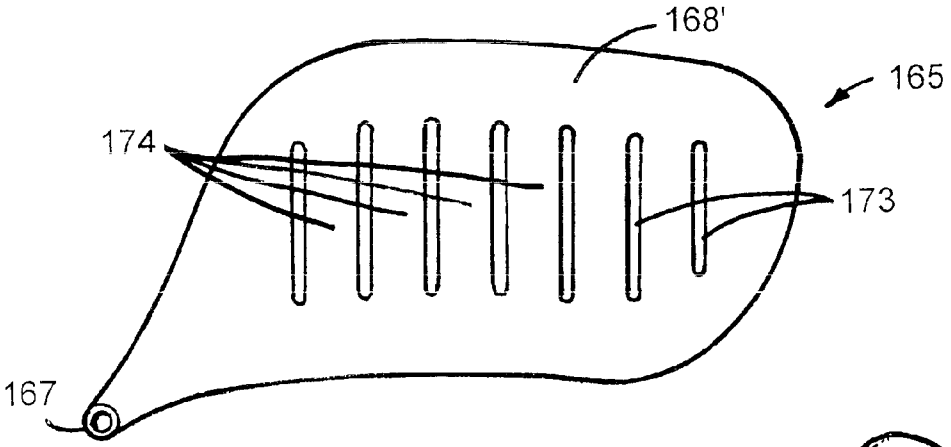
FIGS. 32–34 are top, side, and front views of the armrest shown in FIG. 29.
Figure 34:
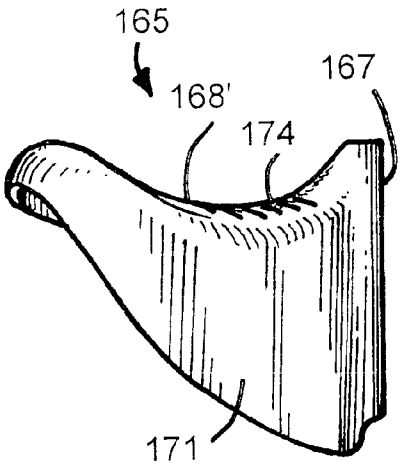
Figure 33:
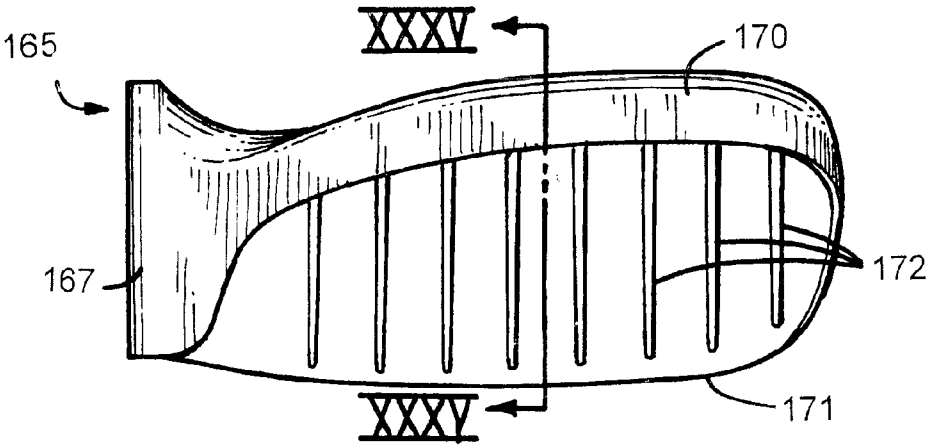
Figure 35:
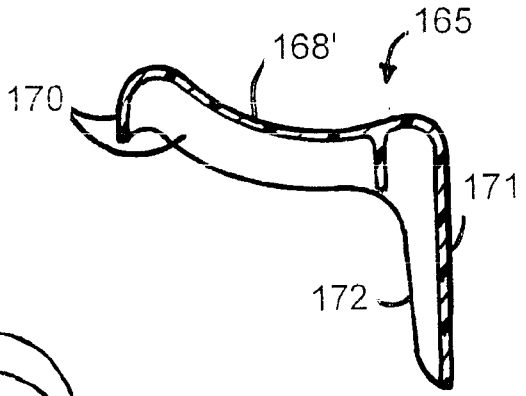
FIG. 35 is a cross-sectional view taken along the line XXXV—XXXV in FIG. 33.
Figure 36:
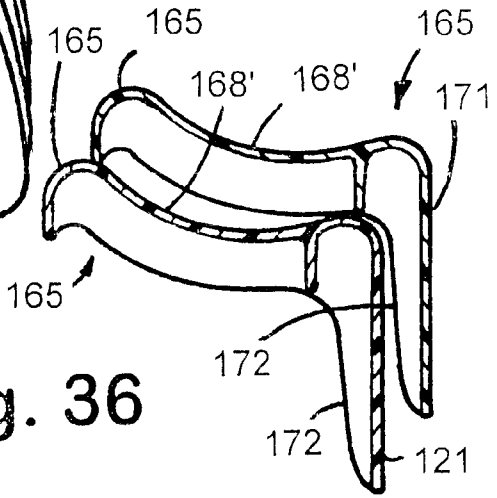
FIG. 36 This a side view similar to FIG. 35, but showing a pair of the armrests on a stacked arrange of the chairs shown in FIG. 37.
Figure 37:
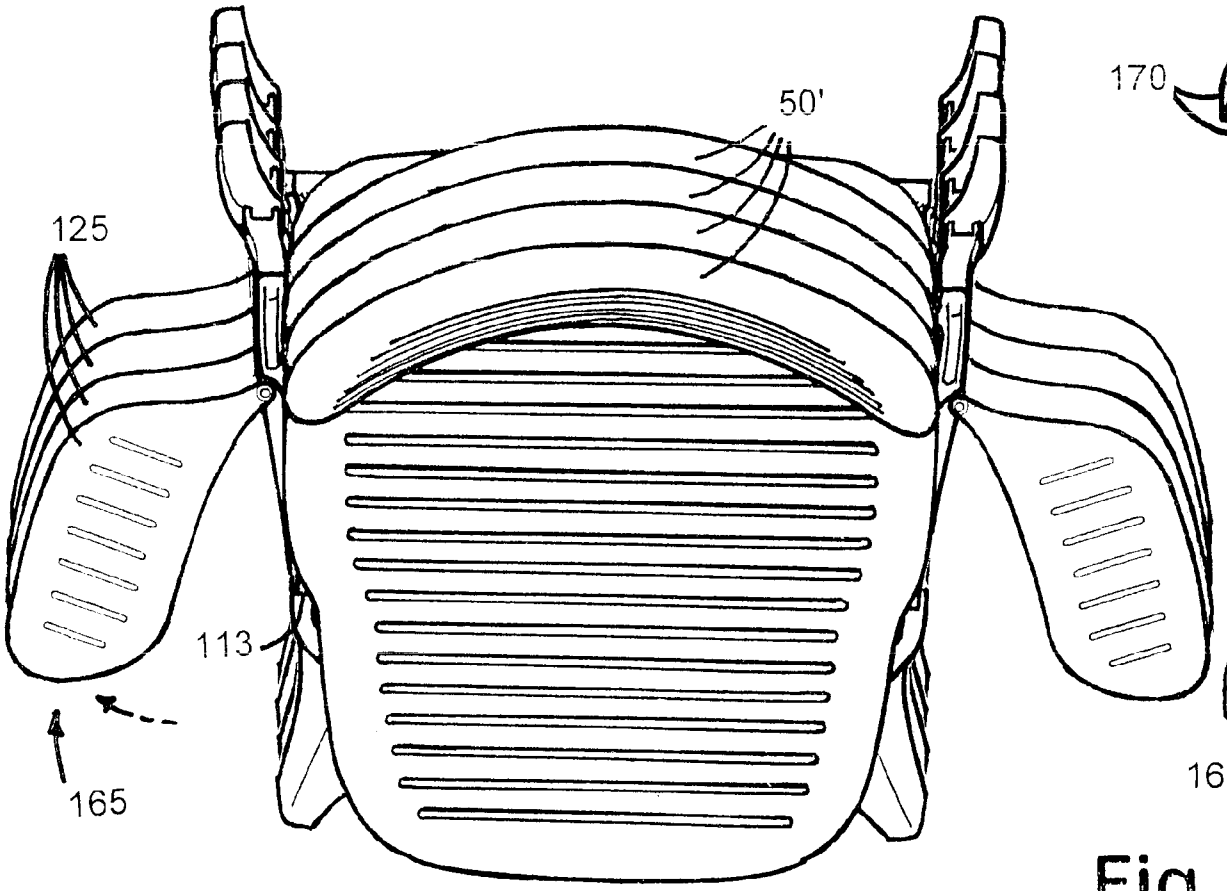
FIG. 37 is a top view of a plurality of seven stacked chairs including the armrests mateably engaging.

In one form of the present invention, armrests 165 (FIG. 29) are attached to a chair 50' similar to chair 50, but having modified levers 125' configured to support armrests 165. In the illustrated embodiment, armrests 165 are pivoted to the lever 126' adjacent the top attachment area 133 of the back 53' for pivotal movement about a vertical axis. Specifically, the top attachment section 133 includes outwardly extending apertured bosses 166 (FIGS. 30 and 31), and the armrests 165 include apertured flanges 167 connected to the apertured bosses 166 by a vertical pivot pin 168. (It is contemplated that the pivot pins 168 could be incorporated into the flanges 167, and even configured for snap attachment between the bosses 166, if desired.) The apertured bosses 166 and flanges 167 are configured to hold the armrests 165 in a selected position, but it is contemplated that they could be designed to move the armrests 165 naturally by gravity toward an inward position. The armrests 165 each have a horizontally extending armrest body panel 168' (FIG. 32) configured to comfortably support a seated user's forearm, and further include a perimeter stiffening flange 170 that extends around the armrest body 168' to reinforce the armrest body panel 168'. An inner portion 171 of the stiffening flange 170 is extended vertically a significant distance so that there is sufficient structure to adequately support the apertured flanges 167, and vertical webs 172 are also added to stiffen armrest body panel 168'. It is contemplated that top and bottom flanges 167 can be used, or an enlargement having a vertical hole can be used on a rear of the armrest 165 to support the pivot pin 168. Slots 173 are formed in the armrest panel 168 to define flexible bands 174. The bands 174 comfortably support a seated user's forearm, but also allow air to circulate about the seated user's forearm. The armrests 165 are configured to mateably engage (see FIG. 36) when the chairs 50' are stacked (see FIG. 37). Also, the slots 173 and webs 172 match the aesthetics of the slots in the seat 52 and back 53, adding to the attractive appearance of the chair 50.

It is contemplated that the present construction includes a distinctive appearance that is inventive and that the armrests compliment such distinctiveness.

However, it is important to note that the chair arm 165 (FIGS. 29–31), like the seat and back, provides a sophisticated ergonomic solution in which a three-dimensional doubly curved form is developed that is anatomically friendly. In other words, the arm 165 has a shape optimized from an ergonomic (comfort and health) perspective. The arm 165 has a pronounced concave shape in transverse section and a very light concave shape in longitudinal section. In plan view, the arm 165 has an inwardly arcuate shape.

In addition to its shape, the arm 165 is designed to rotate along a nominally vertical axis of pivot pins 168. This rotation will have a very slight preload through a spring or helical screw medium. It is designed to afford the person using the arm 165 the opportunity to move the arm 165 spontaneously in a lateral (rotational) direction. This is philosophically analogous to the articulating action of the chair 50 itself. The goal is to provide an arm 165 that is ergonomically refined and one in which the orientation of the arm(s) 165 will spontaneously adapt to user preference. Further, another function of the rotation of arm 165 is to accommodate the lateral stacking. These arms 165 will automatically rotate out of the way to make room as additional chairs are added to the stack.

The arm 165 is preferably injection molded from the same high-performance thermoplastic as the seat 52 and back 53. Like the seat 52 and back 53, the arm 165 is slotted to provide air circulation for naturally cooling, and like the seat 52 and back 53, the arm 165 would not be upholstered (albeit that it could be upholstered if desired). Again, like the seat 52 and back 53, the goal is to provide a high level of ergonomic performance and comfort without the reliance on padding and upholstery. Also, the chair arm 165 represents a zone of high vulnerability to wear and soiling. The highly durable surface of this polymer arm 165 results in a surface of very long life and low maintenance. Again, the goal of minimizing weight is sustained by this arm design.

When a seated user initially sits in the chair 50 (FIG. 5), the forward location of the seat-to-base pivot 62 and also the vertical arrangement of pivots 63–65 cause the chair 50 to provide a relatively firm and stable-feeling chair construction. When the seated user initially leans rearwardly, the back 53 pivots about the seat-to-back pivot 63, causing the link 54 to move from its upwardly extending "at rest" or upright position and to pivot forwardly against the bias of spring 55. The rate of recline of the back 53 is initially significantly faster that that of the seat 52, but it is noted that the specific ratio of angular rotation of the back 53 to the seat 52 varies during recline. As the seated user reclines an additional amount, a small angular rotation of the back 53 results in a significant angular rotation of the link 54, and in turn a significant bending of the spring 55, thus providing increasing support for a user as they lean rearwardly. At an extreme rearward position of maximum recline, the back 53 is about perpendicular to the link 54. In this "fully reclined" position, any attempt to further recline the back 53 will result in forces that extend longitudinally through the link 54 and through the pivots 64 and 65. Thus, any additional force to pivot the back 53 rearwardly does not result in any additional rearward rotation of the back 53. By this arrangement, the links 54 naturally limit recline of the back 53.

Chairs 50 (FIG. 11) are configured for high density storage. For convenience, the operation of nesting the chairs 50 together is described as if a first one of the chairs 50 is rested on a floor. However, it should be clear that a wheeled cart having an angled support surface or holder can be used so that the chairs are stored at any angle relative to a building floor that is desired. Notably, the angle supporting the nested chair affects their storage density, but also affects the height that the chairs must be lifted in order to nest the chairs.

To store the chairs, a "non-stacked" chair 50 is slid primarily horizontally onto the previously stored mating chair along a stacking direction "A" (FIG. 11) into a nested arrangement with the protruding portion of the base 51, including the front beam section 68, being moved into the open structure or throat of the "previously stored" chair 50. As the "non-stacked" chair 50 engages the previously stacked chair, the horizontal rib 70 of the side beam sections 67 of the "non-stacked" chair 50 engages the outer surface of the angled mid portion 74 of the previously stored mating chair 50, facilitating their nested engagement (see FIG. 7M). The "non-stacked" chair 50 is slid into engagement with the previously stacked chair 50 until the front beam section 68 of one chair 50 engages the front beam section 68 of the other chair 50. When the chairs 50 are fully nested, the seats 52 and backs 53 of the two chairs are relatively close together and adjacent each other. The illustrated chairs 50 can be engaged to a nested stacking density of one chair in less than two inches along the stacking direction, although it is contemplated that stacking densities of one chair every three or so inches will also provide excellent benefits to a using entity. Specifically, the present chairs stack to a density of 1.3 inches horizontal and 0.95 inches vertical. The total weight of the illustrated chair 50 can be made as low as 10 pounds, such that the chairs 50 can be easily lifted and stacking is easily accomplished, particularly in view of the track-assisted horizontal engagement and the lightweight of the chairs.

Modification

Additional chairs are disclosed herein that include many features and components that are similar or identical to the components of chair 50. Those features and components that are similar or identical are identified by the same identification number but with the addition of the letters "A", "B" and etc. This is done to reduce redundant discussion and paperwork, and not for another purpose, with the exception that it is possible to interchange many components such as seats 51–51L and back shells 125–125L, as will be apparent from a review of the discussion below and the attached drawings.

Figure 44:
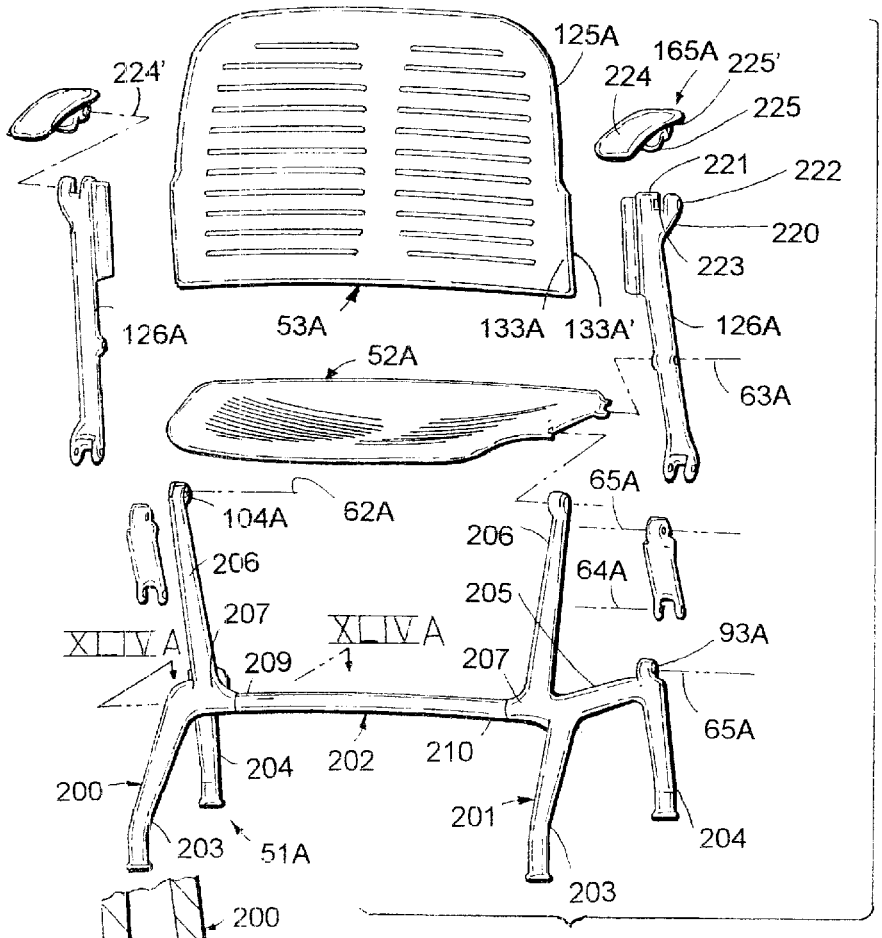

The chair 50A (FIG. 38) includes a base 51A, a seat 52A pivoted to the base 51A at a seat-to-base first pivot 62A, and a back 53A pivoted to the seat 52A at a back-to-seat second pivot 63A. A pair of up links 54A (sometimes called "upwardly-directed links") (FIG. 44) are pivoted to a rear of the base 51A at a link-to-base third pivot 64A and to a bottom of the back 53A at a link-to-back fourth pivot 65A to form a four-bar linkage arrangement with the seat 52A and the back 53A. A resilient spring, such as rubber torsion spring 55A (FIG. 57B), is incorporated into the links 54A to bias the links 54A and in turn bias the back 53A and seat 52A toward upright positions. The pivots 62A, 63A, 64A and 65A (and also the axes that they define) are in the same relative locations and have the same geometric ratios as in chair 50. The advantages of low cost, light weight, stackability, ergonomics and other items noted above that are associated with the chair 50 also are provided by the chair 50A.

Figures 55, 55A, 57, 57A, 57B:
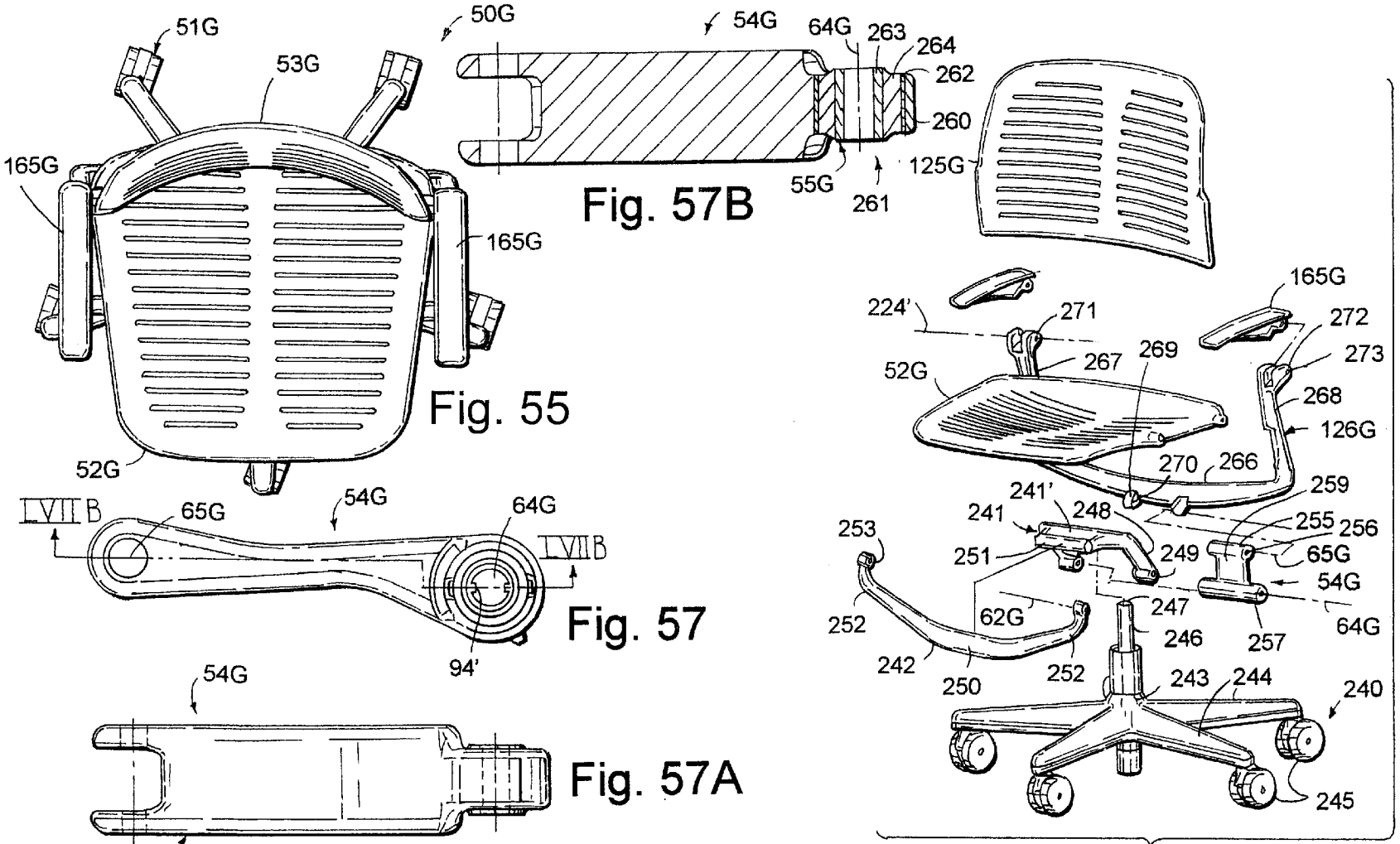
FIGS. 57 and 57A are side and rear views of the link shown in FIG. 56.
FIG. 57B is a cross section taken along lines LXXVII—LXXVII in FIG. 57.

Each of the illustrated links 54A (FIG. 57–57B) is a one-piece molding. Each link 54A includes a top cylindrical section 255 with a horizontal hole 256 for receiving a pivot pin to define top link pivot 64A, and includes a bottom cylindrical section 257 with a horizontal hole for defining the bottom link pivot 65A. The sections 255 and 257 are interconnected by a body section 259. FIG. 57B is a cross section taken along lines LVII—LVII in FIG. 57, and shows the bottom cylindrical section 257 as including the torsion spring arrangement for biasing the back 53A and seat 52A to their upright "at-rest" positions. However, it is noted that the torsion spring arrangement can be at any of the pivots 62A–65A, and that different biasing devices can be used in the chair 54A as discussed above.

The base 51A (FIG. 44) is an assembly of three gas-assisted hollow injection-molded parts, including left and right frame members 200 and 201 (which are "h" shaped in side view) are interconnected by a tubular transverse frame member 202. The frame members 200–202 are hollow and tubular, such that they form a very strong "bone-like" structural member capable of withstanding significant load, yet they are relatively light in weight and have a high strength-to-weight ratio. Gas-assisted injection molding processes are known in the art, such that a detailed description of them is not required herein for an understanding of the present invention nor for an understanding of how to manufacture the present components. Nonetheless, briefly described, a gas-assisted injection molding process is generally described as follows. Initially, the opposing dies of an injection mold are closed, and molten plastic material is injected into the cavity of the opposing dies to fill the cavity. Gas is then injected into a center of the part while a core of the material is still molten to evacuate excess material. Gas-assisted injection molding results in a thick-walled tubular or hollow part that is structural yet light in weight.

It is noted that the seat 52A and back shell 125A of back subassembly 53A are also gas-assisted injection molded. Specifically, the seat 52A (FIG. 40*c*) includes a perimeter section 52A' that is tubular and hollow, and an integrally molded sheet-like panel 52A" with slots formed therein for good ergonomic and flexible support. The back shell 125A also includes a perimeter section 53A' that is tubular and hollow, and an integrally molded sheet-like panel 53A" with slots formed therein for good ergonomic and flexible support. The perimeter sections 52A' and 53A' both provide a rigid tubular perimeter frame that is relatively stiff yet light in weight. The sheet-like panels 52A" and 53A" provide a resilient support that is comfortable and that will flex with a seated user for comfortable support, even without a cushion. Also, the slots provide airflow for increased comfort, since it avoids causing a seated user to sweat.

The frame members 200 and 201 each include front and rear legs 203 and 204 interconnected by a longitudinal element or section 205. A seat support 206 extends upwardly from the longitudinal section 205 at a location close to the front leg 203. A mounting section 207 is located inboard of the intersection of the seat support 206 with the longitudinal section 205. In frame members 200 and 201, molten material is injected into one of the legs or at a center location, and gas is then injected to cause the molten plastic to evacuate along a core of the part, causing the part to form a final hollow geometric shape. The longitudinal frame member 202 is similar molded. (Alternatively, the longitudinal frame member 202 could simply be a roll-formed or extruded tube section.) After injecting the gas, the material cools until it holds the final geometric shape of the part, and then the part is ejected or otherwise removed from the mold. A hole 104A is formed atop the seat support 206 for receiving a pivot pin to form the axis 62A. A second hole 93A is formed above the rear leg 203 for receiving a pivot pin to form the bottom link axis 65A. The holes 104A and 93A can be formed in the frame members 200 and 201 as formed, or the holes can be drilled or formed in the part after molding. A tubular bushing may be inserted in the holes 104A and 93A for improved strength and durability.

Figure 44B:
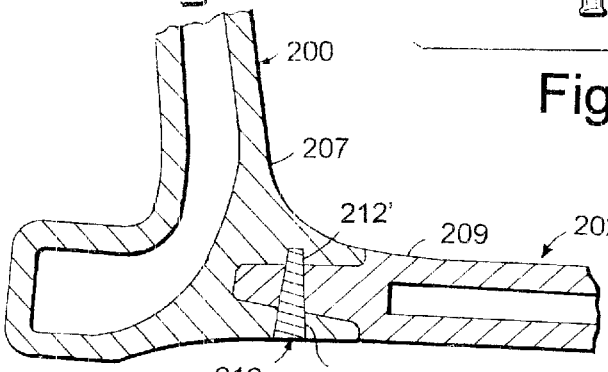
FIGS. 44A, 44B and 44C are cross sections taken along the line XLIV—XLIV in FIG. 44, the FIGS. 44A, 44B and 44C each being alternative constructions of the joint shown.
Figure 44A:
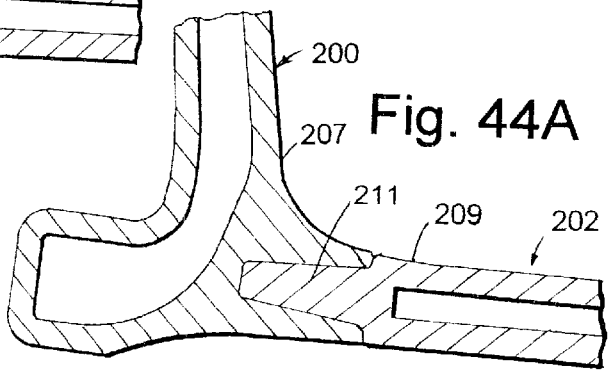
Figure 44C:
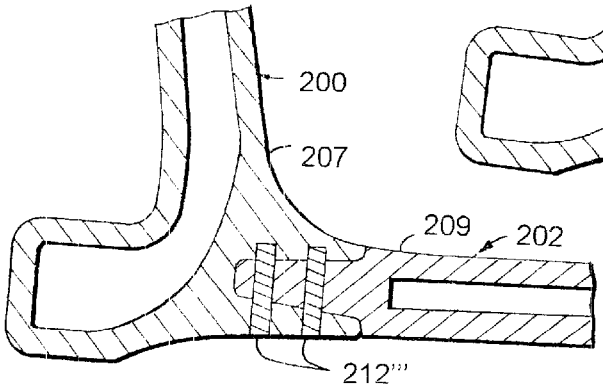

The transverse frame member 202 is an elongated part having a relatively constant hollow cross section terminated in configured ends 209 and 210. The ends 209 and 210 each are adapted to mateably engage recesses in the mounting sections 207. In FIG. 44A, the end 209 fits into the mating recess in mounting section 207 in a post and socket arrangement and is held therein by a structural adhesive layer 211. In the alternative construction shown in FIG. 44*b*, a similar post and socket arrangement is formed, but the adhesive is replaced with a screw 212 that extends transversely into the joint. The screw 212 has an unthreaded tapered tip 212' and a threaded shaft 212". In the alternative construction shown in FIG. 44C, a similar post and socket arrangement is formed, and is held together by a pair of parallel pins 212"' that extend longitudinally transversely through the longitudinal frame member 202 and into the mounting section 207. Numerous different interconnecting arrangements are possible, and the present invention is not believed to be limited to a single construction.

Figure 3:
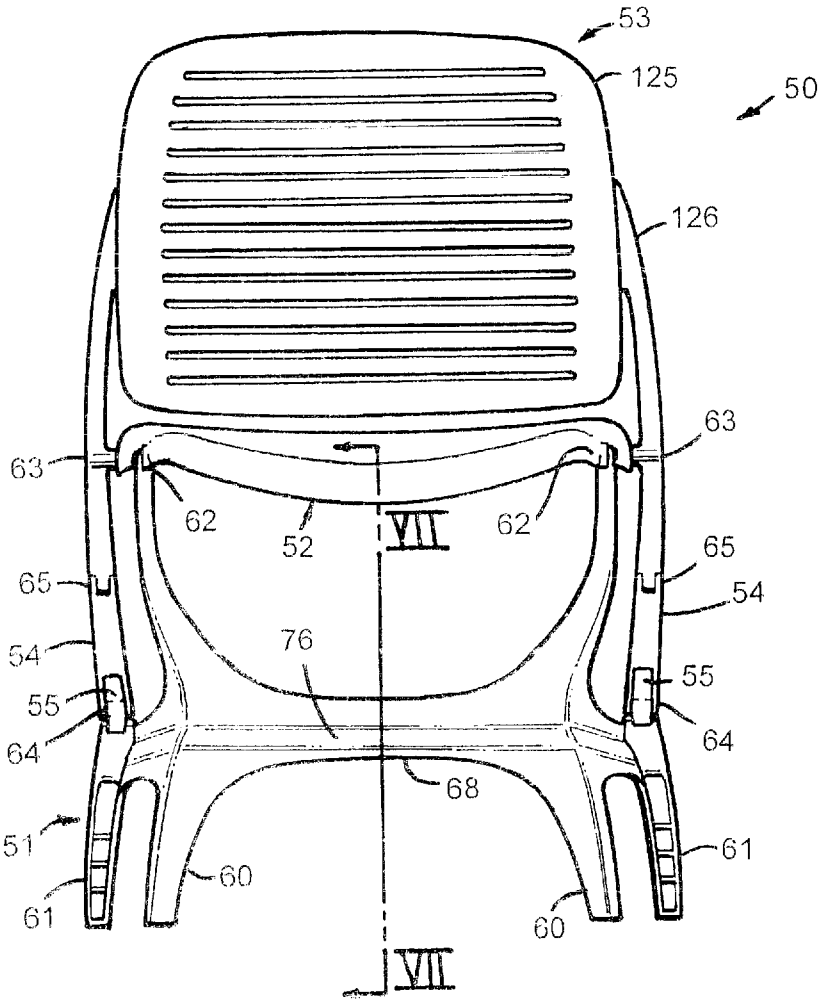
Figure 4A:
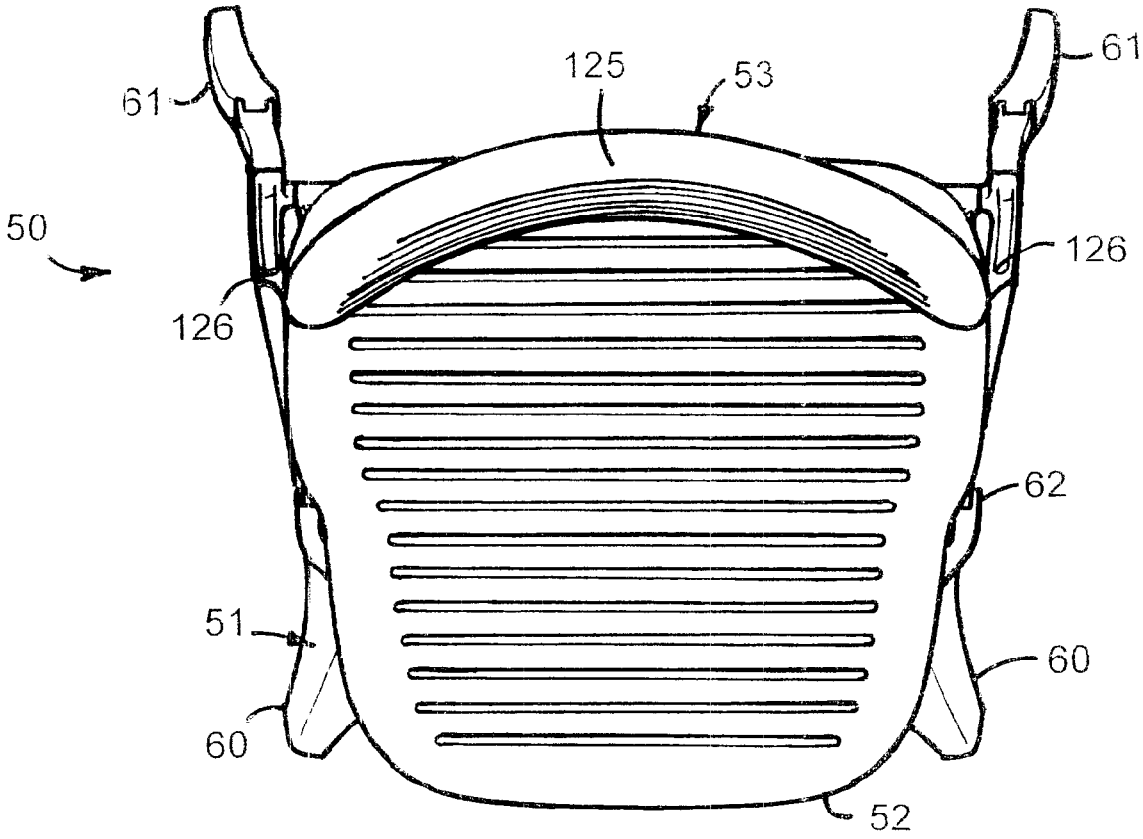
Figure 6:
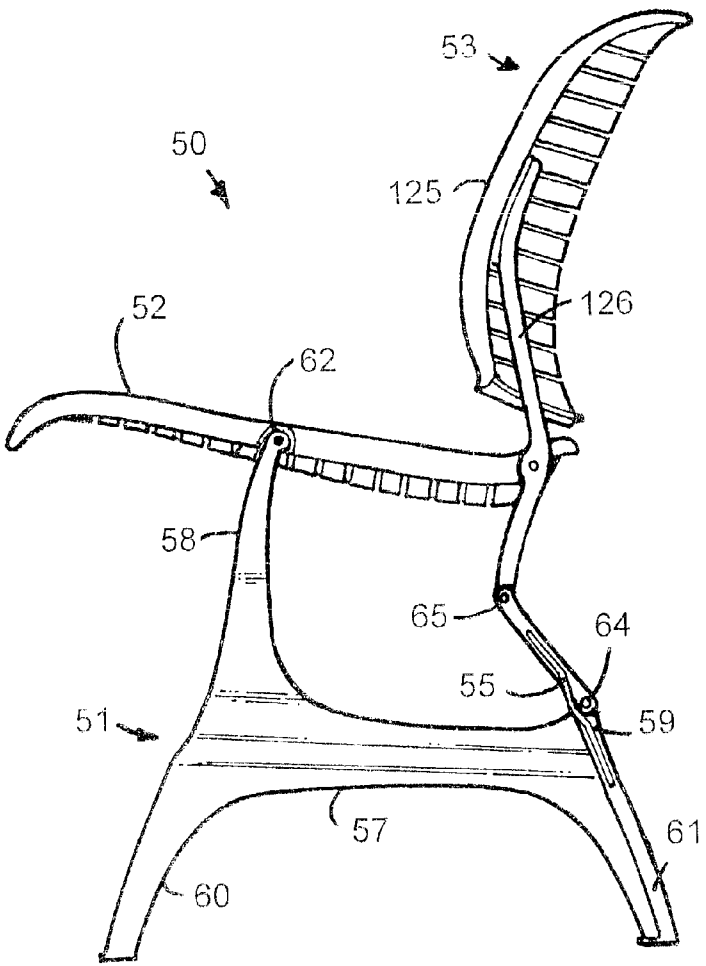
FIGS. 5 and 6 side views of the chair shown in FIG. 1, FIG. 5 showing the back in an upright position and FIG. 6 showing the back in a reclined position.
Figures 7, 7A, 7B, 7C, 7D, 7E, 7F, 7G, 7H, 7I, 7J, 7K, 7L, 7M:
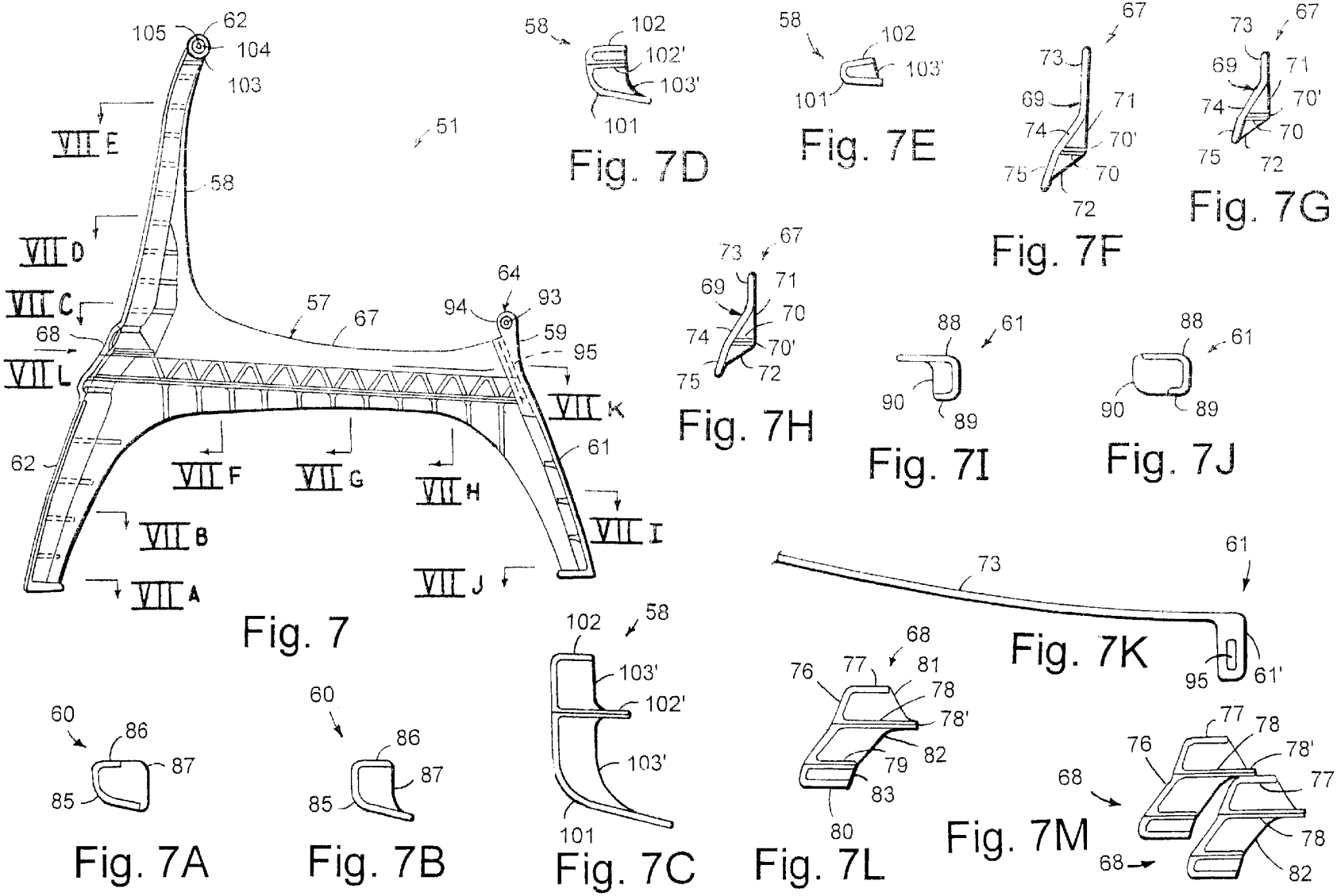
FIG. 7 is a cross-sectional view taken along lines VII—VII in FIG. 3.
FIGS. 7A–7L are cross-sectional views taken along lines 7A–7L, respectively, in FIG. 7.
FIG. 7M is a cross-sectional view similar to FIG. 7L, but showing the relationship of transverse front section of the bases in a pair of the chairs nested together.
Figure 8:
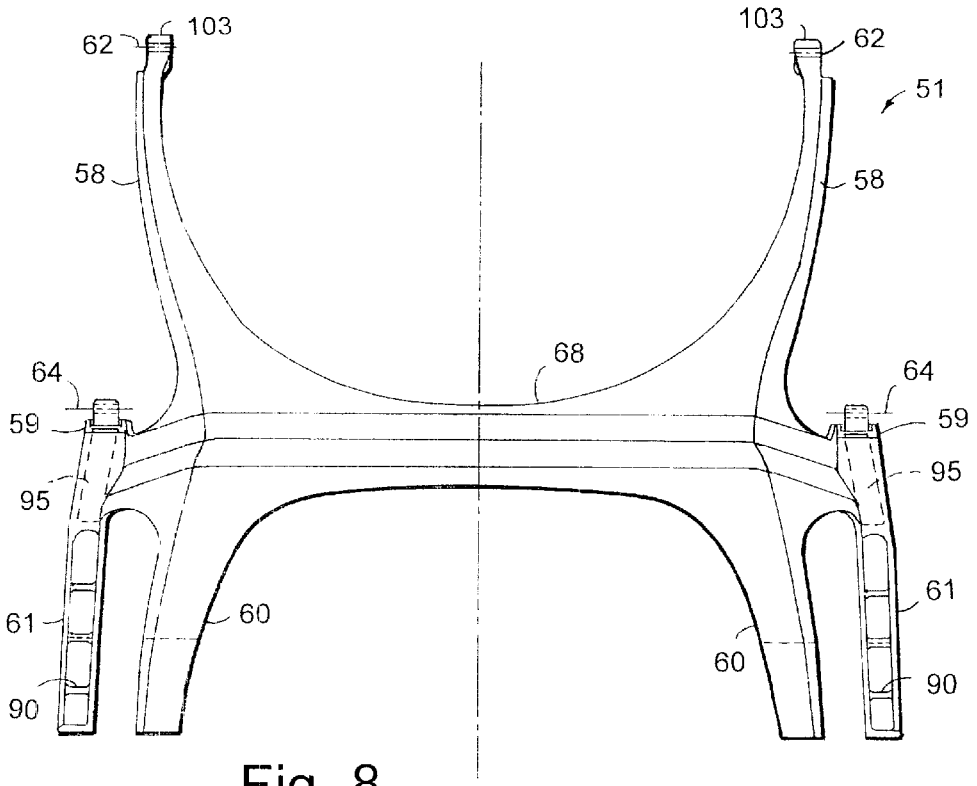
FIGS. 8–10 are front, rear, and top views of the base shown in FIG. 7.
Figure 9:
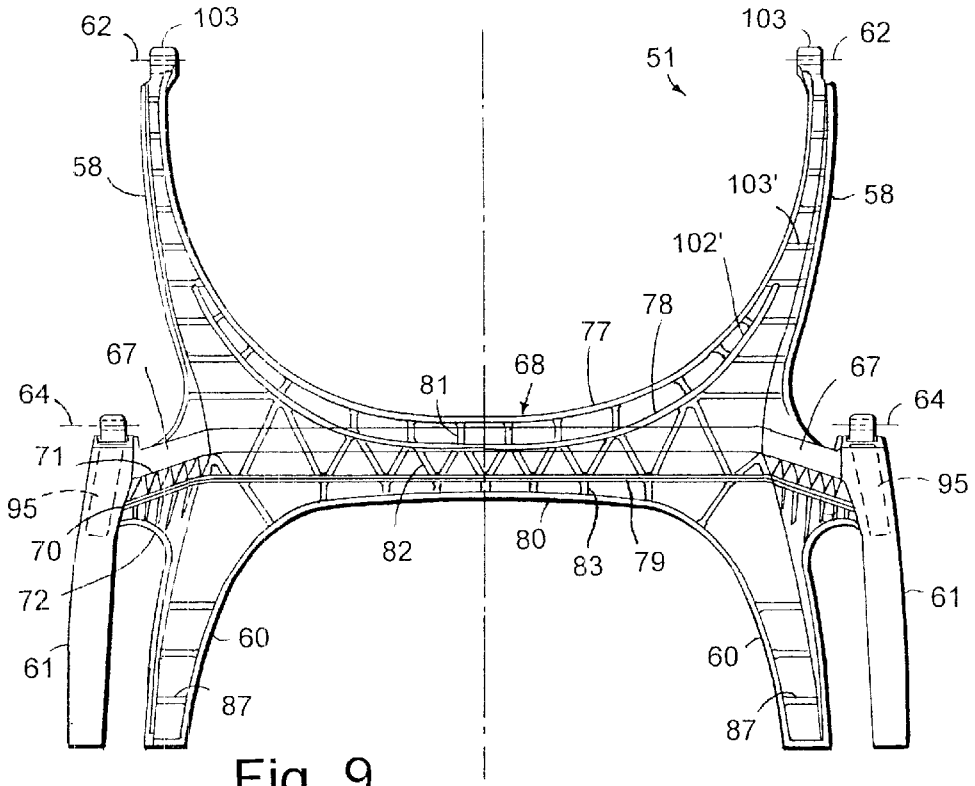
Figure 10:
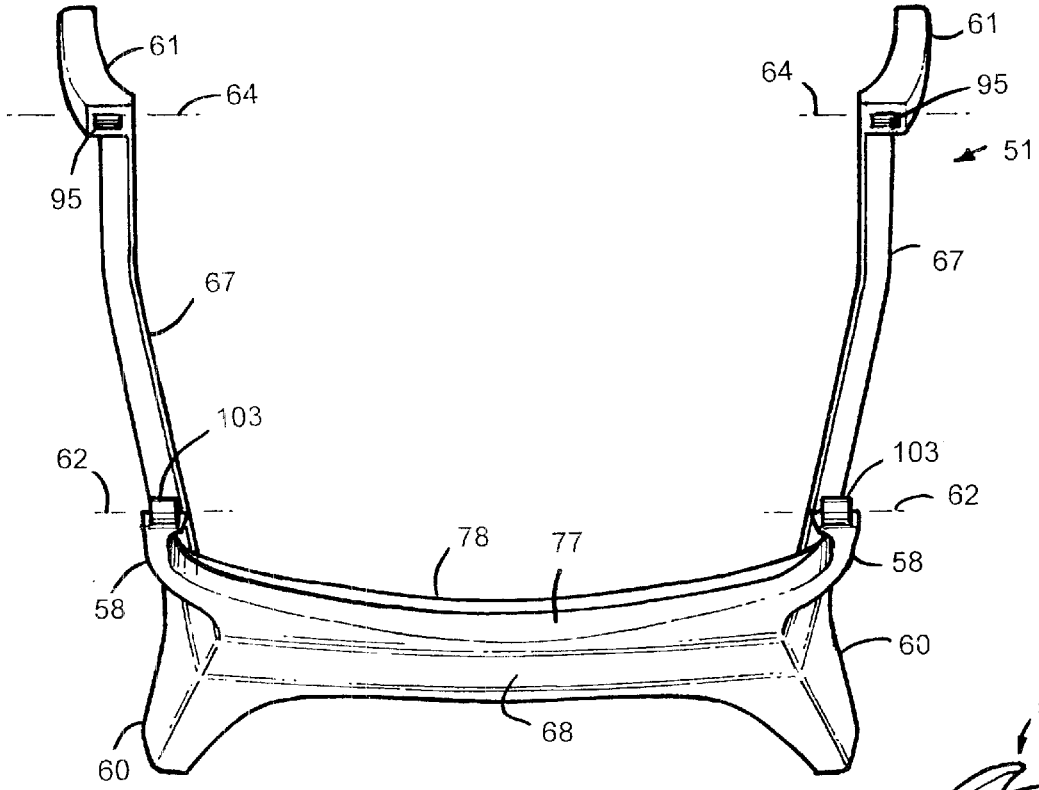
Figure 23A:
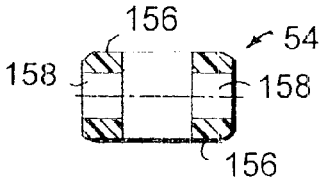
FIGS. 23A–23E are cross-sectional views taken along the lines TT–ZZ', respectively, in FIG. 24.
Figure 23B:
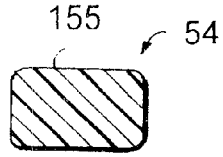
Figure 23C:
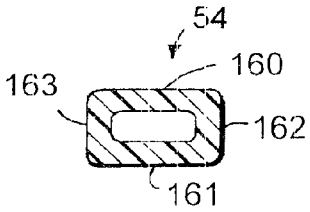
Figure 23D:
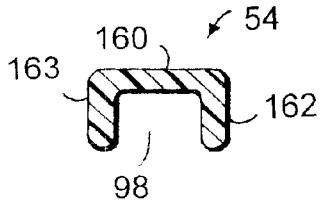
Figure 23E:
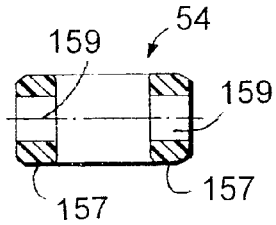
Figure 23:
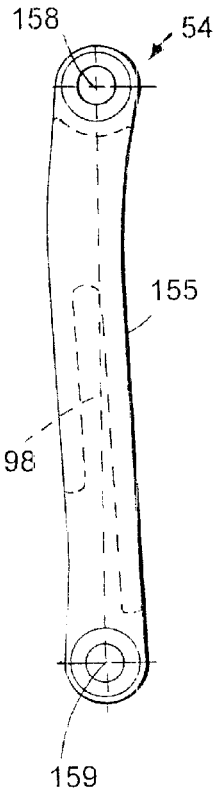
FIGS. 23 and 24 are side and front views of the link shown in FIG. 5.
Figure 24:
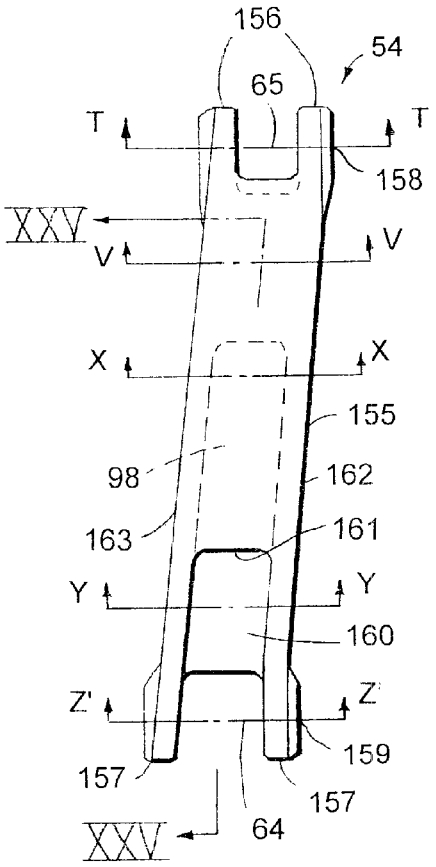

Alternatively, instead of a rubber torsion spring(s), it is contemplated that a leaf spring similar to spring 55 of chair 50 could be used if desired (see FIGS. 7, 23 and 3). The pockets for receiving the leaf spring could be machined into the components 51A and 55A, or the pockets can be formed in the parts when molded. Notably, the seat axis 62A is relatively near to a center of gravity when a person is seated in the chair 50A, even during recline (since the seat 52A pivots to shift a person's weight forward upon recline), such that the leaf springs or other biasing device for moving the back and seat 53A and 52A do not need to be very strong to be effective.

As noted above, the back subassembly 53A includes a back shell 125A and fixed levers 126A (sometimes called "back supports" or "back support arms" herein) attached to the back shell 125A on either side at locations 133A. Specifically, the location 133A includes a recess 133A' formed in a lateral side of the back shell 125A, and the fixed levers 126A include a protruding tongue shaped to mateably fit into and engage the recess. The joint can be held together with structural adhesive or by screws that extend horizontally through the fixed lever 126A into a top of the fixed lever 126A. In yet another alternative, a fastener or wedge can be extended vertically upwardly to transversely engage the protruding tongue of the fixed lever 126A to retain it in the recess of the back shell.

Figures 45, 46, 47:
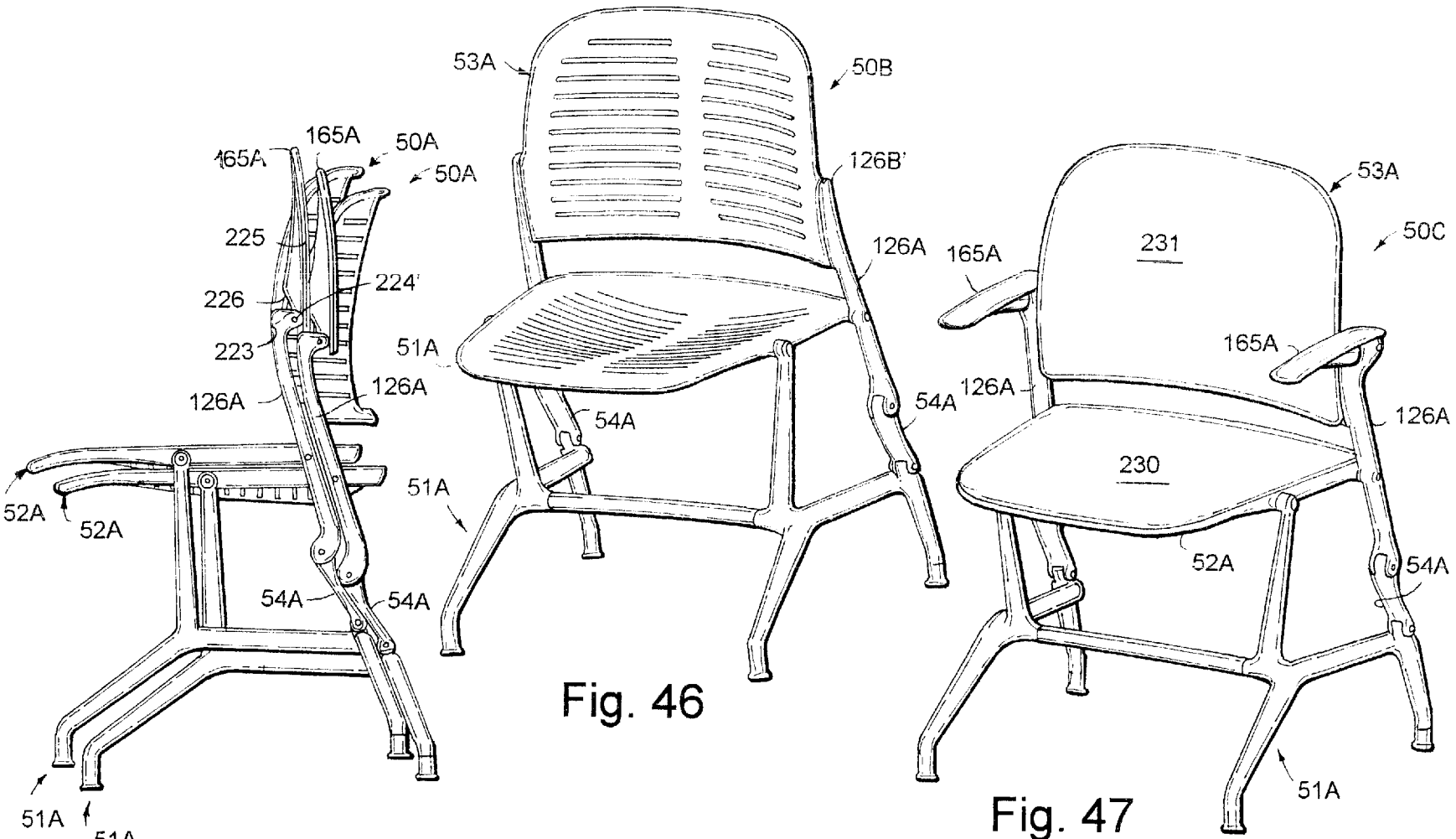
FIG. 45 is a side view of two chairs of FIG. 38 shown in a stacked/nested arrangement.
FIG. 46 is a perspective view of a chair similar to FIG. 38 but without armrests.
FIG. 47 is a perspective view of a chair similar to FIG. 38 but with seat and back cushions and armrests.

An enlargement 220 is formed atop the fixed lever 126A, and includes spaced-apart sections 221 and 222 with a recess formed therebetween defined by a bottom surface 223. The armrest 165A includes a forearm supporting section 224 and a mount 225. The mount 225 includes a hole that aligns with holes in the spaced apart sections 221 and 222, and is pivotally connected thereto by a pivot pin for movement about a horizontal armrest pivot axis 224' between a horizontal use position (FIG. 40) and a vertical storage position (FIG. 45). The forearm supporting section 224 has a T-shaped cross section and includes a relatively flat wall section 225 (FIG. 45) and a perpendicular reinforcement section 226. When the armrest 165A is in the horizontal use position (FIG. 40), the perpendicular reinforcement section 226 engages the bottom surface 223 to hold the armrest 165A at the desired angle. When the armrest 165A is in the vertical storage position, a rear of the reinforcement section 226 rotates into engagement with a rear surface of the mount 225, thus holding the armrest 165A in the vertical storage position. (FIG. 45.) If desired, the armrest 165A can be pivoted for non-frictional free movement, such that it is easily moved between the use and storage positions, but it is contemplated that some friction is desirable to prevent the armrest 165A from undesirably flopping between positions.

It is noted that the armrest pivot axis 224' is located rearward of a front surface of the back shell 125A (see FIG. 45), and further that the top surface of the fore-arm supporting section 224 is located rearward of the front surface of the back shell 125A when the armrest 165A is in the vertical storage position. This is advantageous since it permits high-density nested storage of identical chairs, as shown in FIG. 45. Further, it is advantageous since the armrest 165A can be rotated to a storage position to open up a side of the chair 50A during use of the chair. Specifically, this provides an unobstructed and open side access to the seat 52A of the chair 50A, which has been found to be highly desirable. More specifically, many synchrotilt chairs have movable backs and seats with armrests intended to restrict the seated user. The present chair allows seated users to sit sideways on the seat 52A, with their legs extending laterally and hanging downwardly off the side edge of the seat in an unobstructed manner. This side-facing position is assisted by and made even more comfortable by the narrow width dimension of a front of the seat 52A. In the storage position, the armrests 126A are positioned totally out of the way, slightly behind the back 53A. As illustrated, the armrests 126A when in the vertical storage position are located adjacent the back shell 125A in a manner that actually creates additional support beside the back shell to effectively "enlarge" the supporting surface of the back 53A.

FIG. 45 shows a stacked/nested arrangement of two chairs 50A, with the armrests 165A being shown in the vertical storage position. It is noted that the armrests 165A must be positioned in their vertical storage position in order to stack the chairs 50A vertically as shown. However, one alternative way of stacking the chair 50A is to provide a cart that allows the chairs 50A to be tipped forward and inverted as the chairs 50A are stacked. As the chairs 50A are inverted, the armrests 165A can be constructed to fall by gravity to the storage position, such that the stacking process does not require an extra movement of the armrests to allow stacking. As noted above, the present chair 50A is sufficiently lightweight to allow a person to easily lift and invert the chair.

Figures 38, 39, 40, 40A, 40B, 40C, 40D:
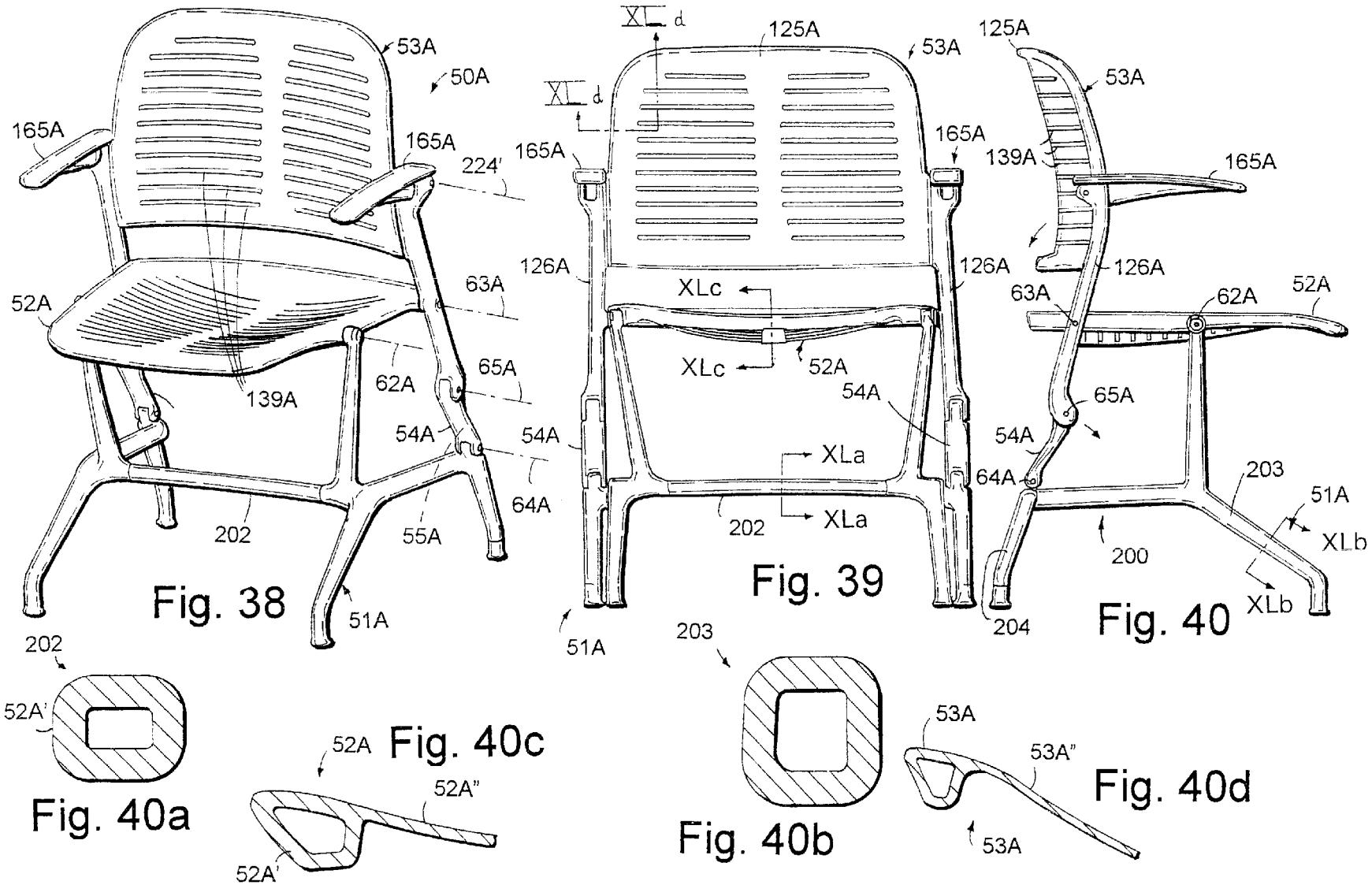
FIGS. 38–44 are perspective, front, side, rear, top, front-exploded and perspective-exploded views of a modified side chair with armrests embodying the present invention.
FIGS. 40*a*–40*d* are cross sections taken along the lines Xla—Xla, XLb—XLb, XLc—XLc, and XLd—XLd in FIGS. 39 and 40.
Figure 41:
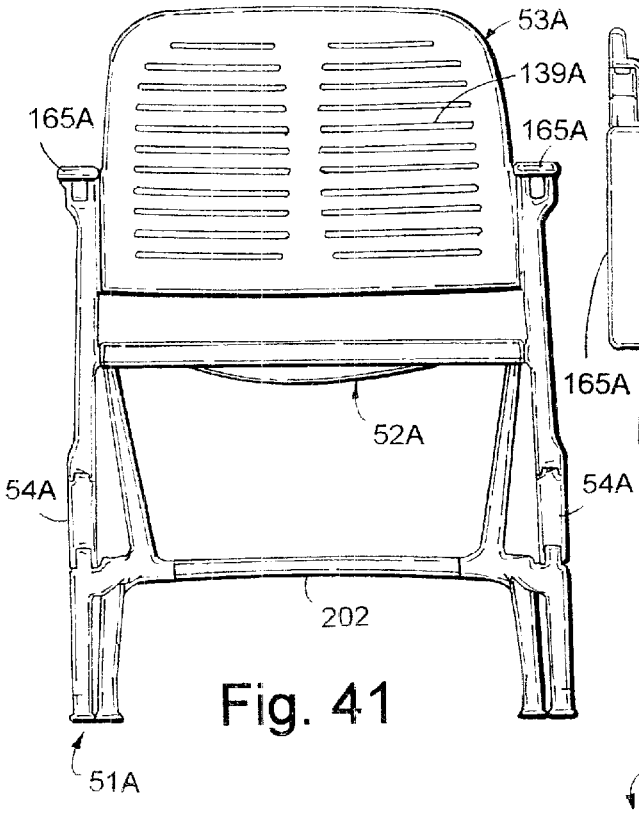
Figure 42:
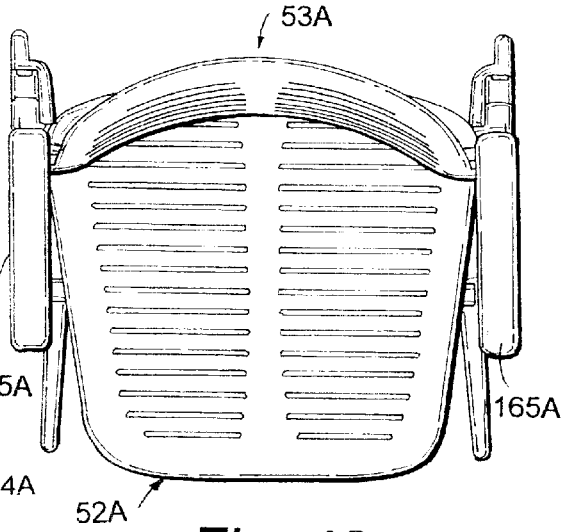
Figure 43:
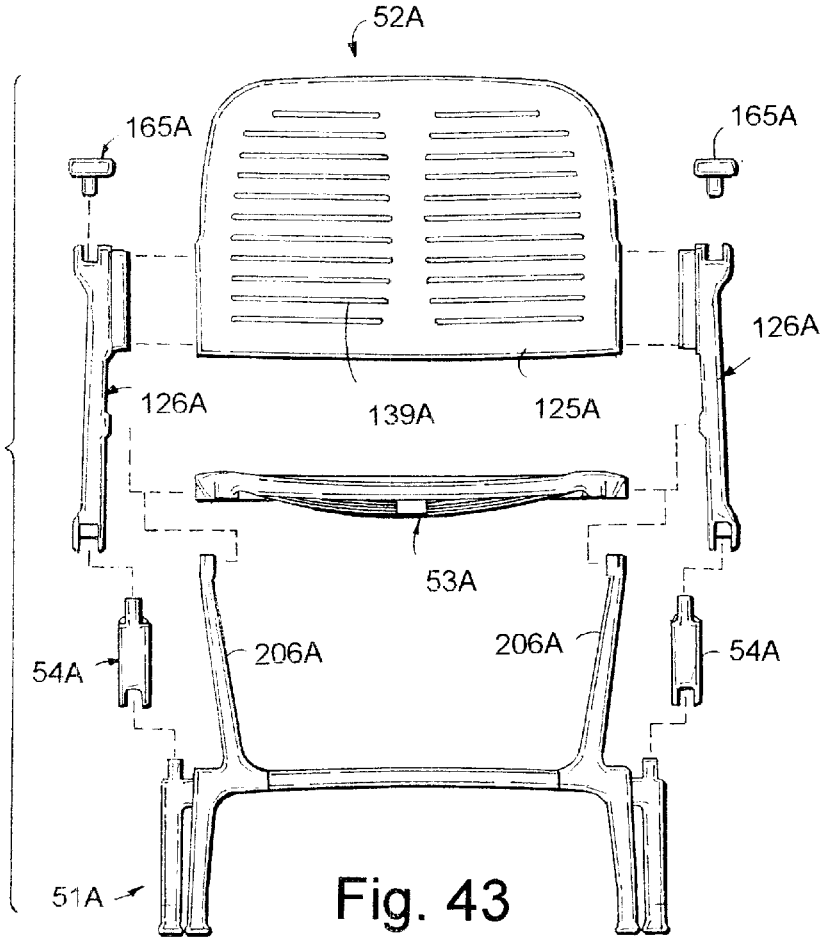

The chair 50B (FIG. 46) is a perspective view of a chair similar to FIG. 38 but without armrests. In chair 50B, the fixed lever 126A includes an aesthetically contoured top 126B'.

The chair 50C (FIG. 47) is a perspective view of a chair similar to FIG. 38 but with seat and back cushions 230 and 231. The chair 50C includes armrests 126A. The cushions 230 and 231 extend to the edges of the seat 52A and back 53A. The cushions 230 and 231 can be permanently or releasably attached to the seat and back shell.

Figure 48:
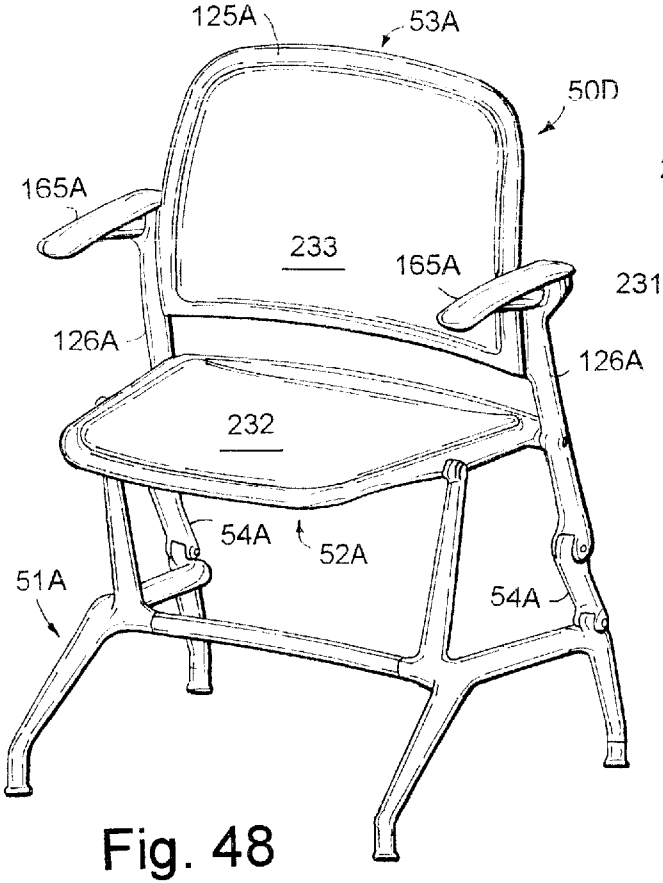
FIG. 48 is a perspective view of a chair similar to FIG. 38 but with modified seat and back cushions and armrests.
Figure 52:
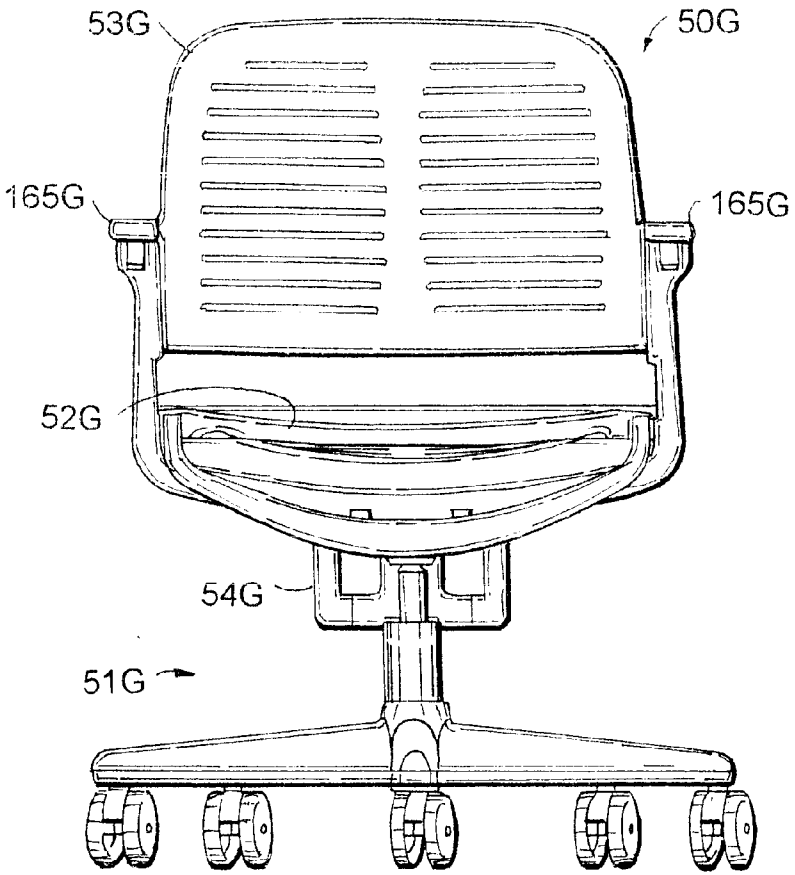
FIGS. 51–56 are perspective, front, side, rear, top, perspective-exploded and side-exploded views of a modified desk chair with armrests embodying the present invention.

The chair 50D (FIG. 48) is a perspective view of a chair similar to FIG. 38 but with seat and back cushions 232 and 233 that are reduced in size. The cushions 232 and 233 include marginal edges that are inboard of a perimeter of the seat and back 52A and 53A by about a half inch to an inch or so. This creates a distinctive appearance, and further helps in assembly. Specifically, it is difficult to provide optimal appearance along the edges of cushions that extend to a non-recessed edge of a seat or back, since the edge of the cushion assembly is easily distorted when people enter or leave the chair seat. For example, the problem can occur along the front and side edges of the seat 52A, where a person is likely to slide onto the seat 52A, which causes the fabric to roll or be torsionally stressed so that it deforms and extends upwardly along its edges. This is also true along a top edge 53A' of the back 53A where the back shell 125A curves noticeably rearwardly and is highly visible.

Figure 49:
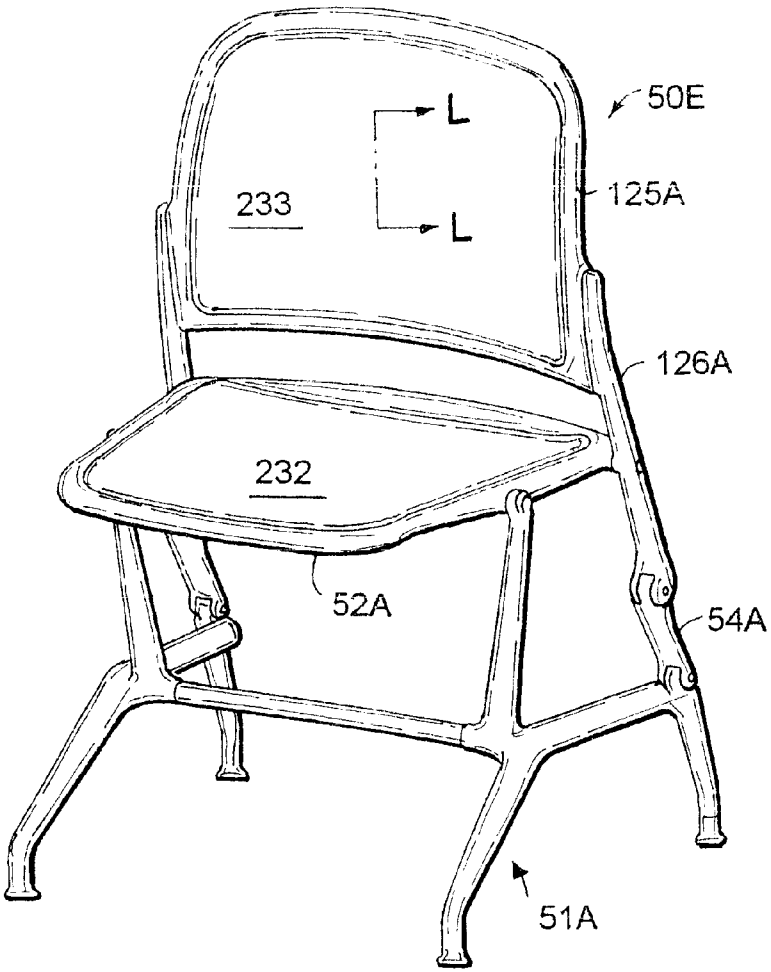
FIG. 49 is a perspective view of a chair similar to FIG. 48 with seat and back cushions but without armrests.

The chair 50E (FIG. 49) is a perspective view of a chair similar to FIG. 38 with seat and back cushions 232 and 233 but without armrests.

Figure 50A:
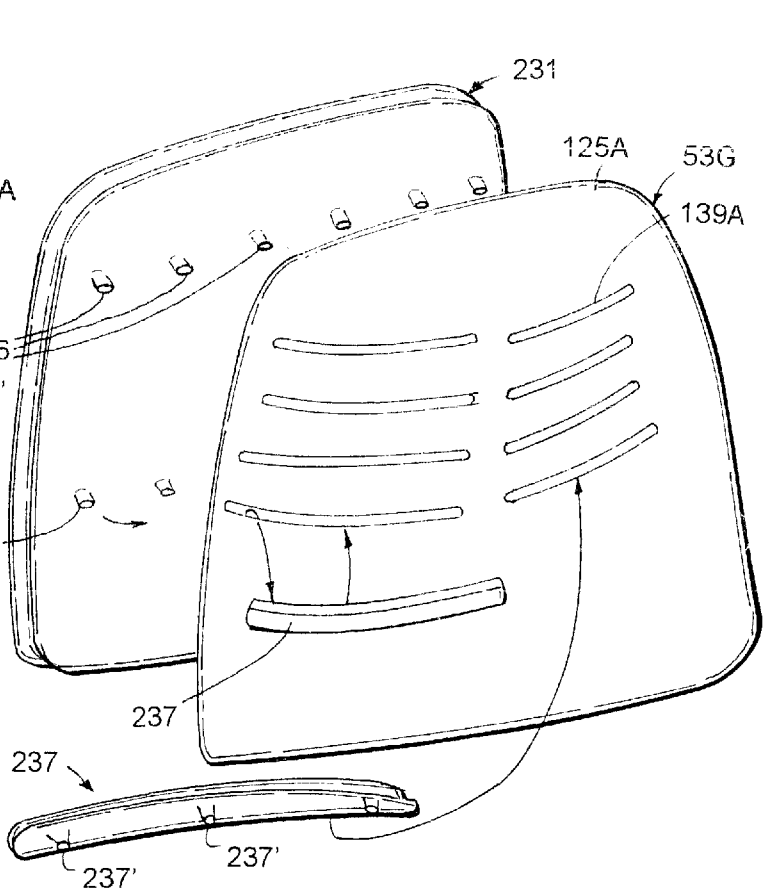
FIG. 50A is an exploded perspective view of the back shell, back cushion and snap attachment member shown FIG. 50.
Figure 50:
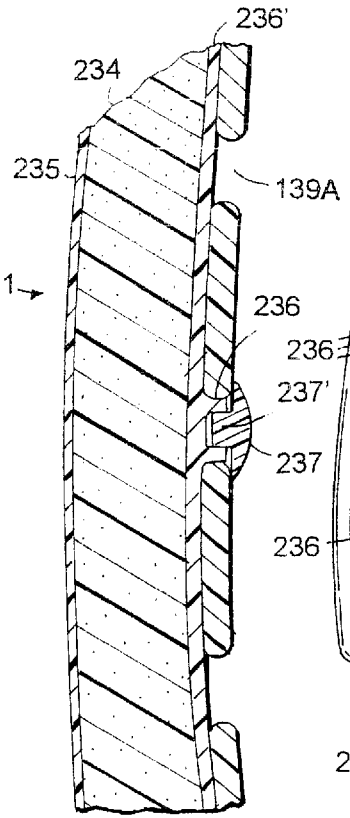
FIG. 50 is a cross section taken along lines L—L in FIG. 49.

It is noted that the cushions 232 and 233 (and also the cushions 230 and 231) can be attached in many different ways. As illustrated, the back cushion 233 (FIG. 50) includes a foam layer 234 covered by an aesthetic covering 235 such as upholstery sheet adhered to the foam layer 234, and further includes a rear semi-structural sheet 236' with attachment bosses 236 extending rearwardly. Elongated retainers 237 each include protrusions 237' having an enlarged end configured to fit through the slots 139A in the back shell 125A, with the protrusions 237' snap-locking into the bosses 236. Alternatively, the protrusions 237' can be threaded, and configured to threadably engage the bosses 236. This provides a unique back cushion attachment device, such that the chair can be sold and used without any back cushion, but where a back cushion can be attached in the field (long after the chair was purchased) while the chair is in service. Alternatively, it is contemplated that protrusions 237 can be an elongated to form a continuous ridge that extends laterally to completely fill a length of one (or more) of the horizontal slots 139A in the back shell 125A. Notably, the end-located protrusions 237 and bosses 236 can engage ends of associated slots 139A, such that they also act as locators for the cushions on the back shell.

Figure 56:
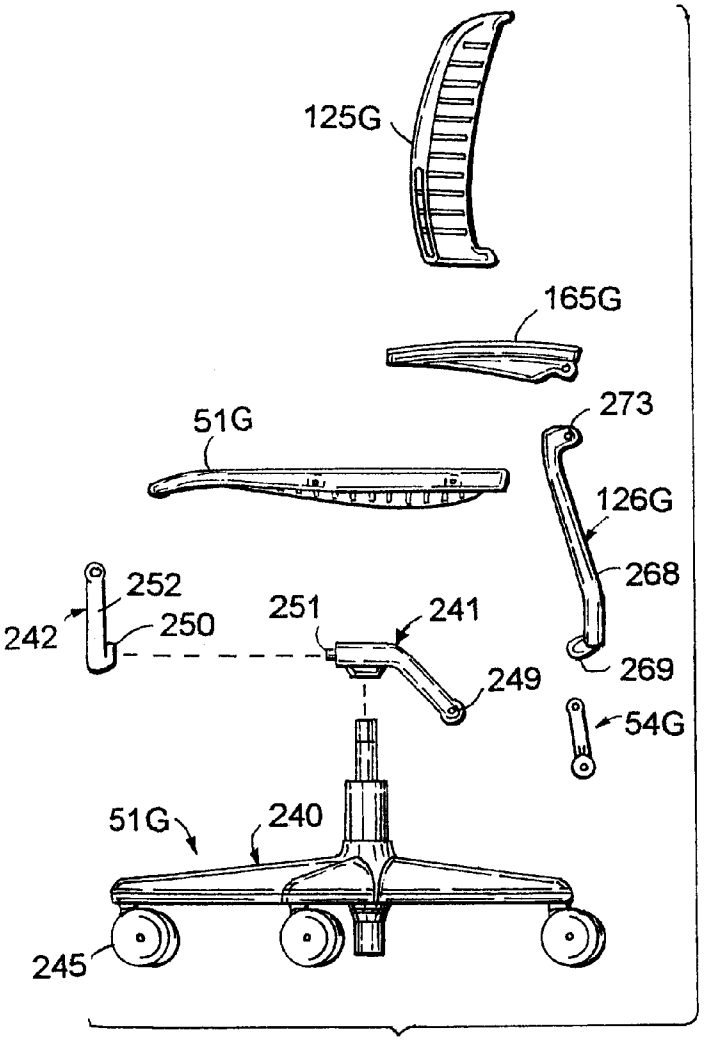

The chair 50G (FIG. 51–56) are perspective, front, side, rear, top, front-exploded and perspective-exploded views of a modified mobile desk chair with armrests embodying the present invention. Chair 50G includes many similar and identical components to chair 50, and in particular pivot axes 62G–65G are similar to that of chair 50 in position and in the ratios of their lengths in the four-bar arrangement. Also, at least the seat 51G, back shell 125G, and armrests 165G are potentially the same identical parts as the seat 51A, the back shell 125A, and the armrests 165A. The base subassembly 51G (FIG. 56) includes a castored spider-legged bottom 240, a height-adjustable underseat support member 241 (sometimes called a "frame member" herein) supported on a height-adjustable pneumatic cylinder 246, and a seat support member 242. The legged bottom 240 (FIG. 55A) includes a hub 243, radially extending legs 244 extending from the hub 243, and castors 245 supported on the ends of legs 244. An extendable pneumatic cylinder or gas spring 246 is securely positioned in the hub and extends vertically. The underseat support member 241 engages a top end of the pneumatic cylinder 246. A control handle (not specifically shown) is pivoted to the underseat support member 241 and has an inner end positioned to engage a release button 247 on the pneumatic cylinder 246 for releasing the pneumatic cylinder 246 for height adjustment. The operation of pneumatic cylinders and gas springs for height adjustment of chairs are well known in the art, such that a further explanation of that feature is not required.

The underseat support member 241 (FIG. 55A) includes a tapered recess in its body 241' for frictionally engaging a top of the pneumatic cylinder 246, and further includes spaced apart legs 248 that extend rearwardly and downwardly at an angle so that a hole 249 is properly located for pivotal attachment at the rear bottom link pivot 65G. The seat support frame member 242 includes a center section 250 configured to mateably engage a protrusion 251 on a front of the underseat support member 241. The center section 250 of the seat support frame member 242 is fastened or otherwise secured to the front of underseat support member 241 by welding, fasteners, or the like. Seat-supporting arm sections 252 extend outwardly and upwardly from center section 250 and include top ends that have holes 253 properly positioned for pivotal attachment at the seat-to-base pivot 62G.

The illustrated link 54G (FIG. 55A) is a one-piece molding having a shape that is different than link 54A, but having a structure, function and operation very similar to the link 54A (FIGS. 57–57B). Specifically, the link 54G includes a top cylindrical section with a horizontal hole for receiving a ribbed pivot pin to define top link pivot 64G, and includes a bottom cylindrical section with a horizontal hole for defining the bottom link pivot 65G.

The bottom section 257 (FIG. 57) includes an outer casing 260 integrally formed of the material of bottom section 257. A torsion spring subassembly 261 is secured in the casing 260, and includes an outer tube 262 non-rotatably secured or keyed or insert-molded into the casing 260, an inner tube 263 non-rotatably secured or keyed into a pivot pin 94G, and a resilient rubber pack 264 integrally secured to the inner and outer tubes 262 and 263. For example, the pivot pin 94G can be longitudinally ribbed, such that the ribs non-rotatably engage an integral key 94G' on inner tube 263 (FIG. 57) (and engage a similar integral key in the mating part forming the pivot). The resilient rubber pack 264 is made of material chosen to stretch and allow torsional movement, but that resiliently biases the tubes 262 and 263 back to a home position. In the present arrangement, the torsion spring subassembly 261 replaces the leaf spring 55 of chair 50.

The fixed lever 126G of chair 50G (FIG. 55A) is a one-piece U shaped part that includes a transverse section 266 and up leg sections 267 and 268. Two mounting protrusions 269 are formed on the transverse section 266 with hole 270 that defines the axis 65G. Mounting sections 271 and 272 are formed on the upper ends of the up leg sections 267 and 268 and include holes 273 for supporting the armrests 165G at axes 224'. The mounting sections 271 and 272 further include structure for engaging sides of the back shell 125 for securely supporting the back shell, in a manner similar to the described above in regard to chair 50A.

Figures 51, 53, 54:
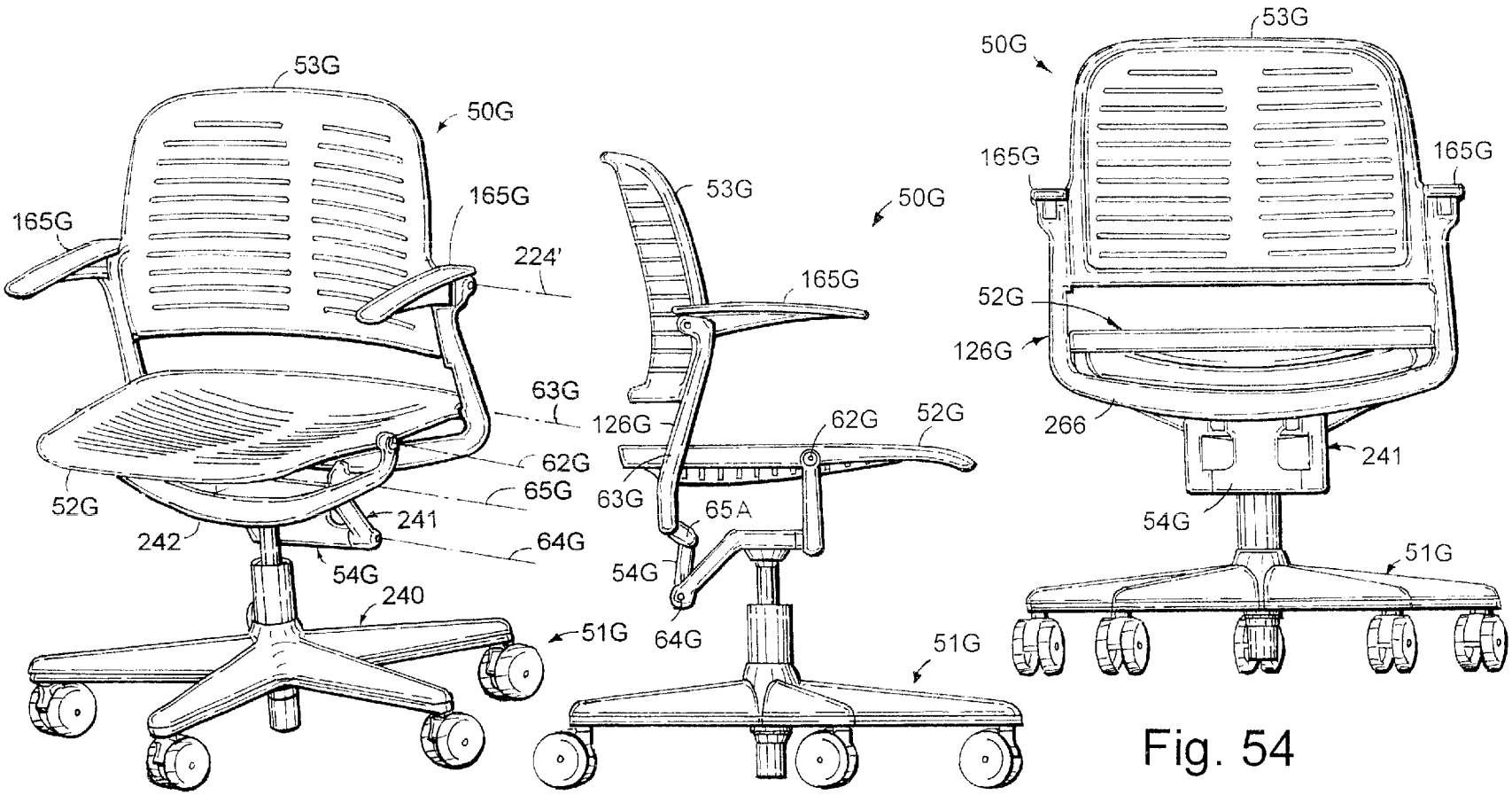
Figure 58:
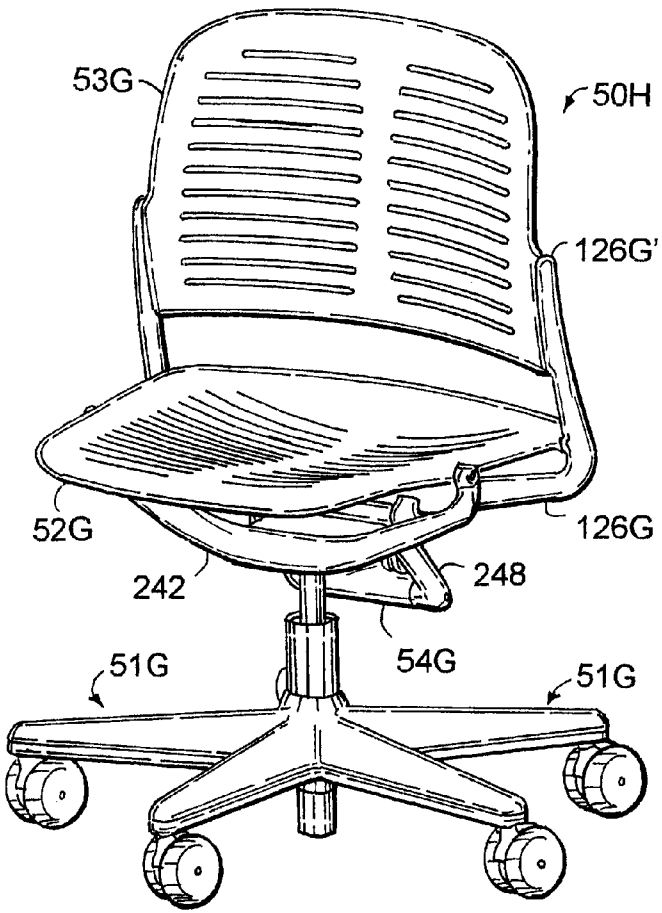
FIG. 58 is a perspective view of a chair similar to FIG. 51 but without armrests.

The chair 50H (FIG. 58) is a perspective view of a chair similar to chair 50G of FIG. 51 but without armrests. The chair 50H is noted as having features particularly similar to chair 50B (FIG. 46).

Figure 59:
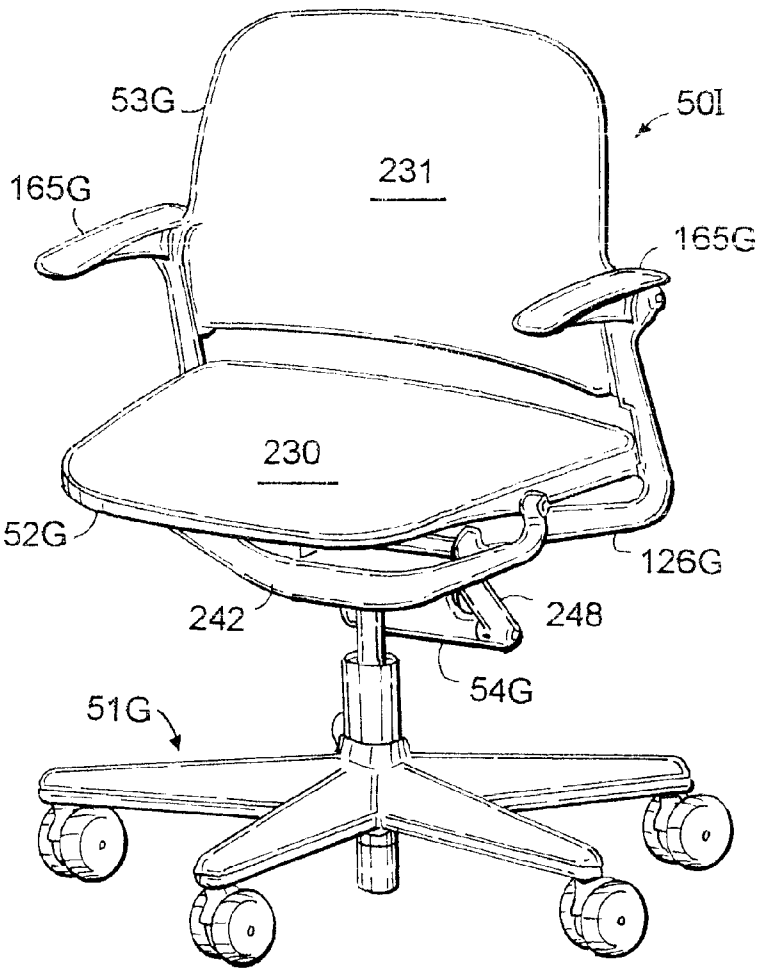
FIG. 59 is a perspective view of a chair similar to FIG. 51 but with seat and back cushions and armrests.

The chair 50I (FIG. 59) is a perspective view of a chair similar to the chair 50G (FIG. 51) but with seat and back cushions 230 and 231. The chair 501 includes armrests 126G. The cushions 230 and 231 extend to the edges of the seat 52G and back 53G.

Figure 60:
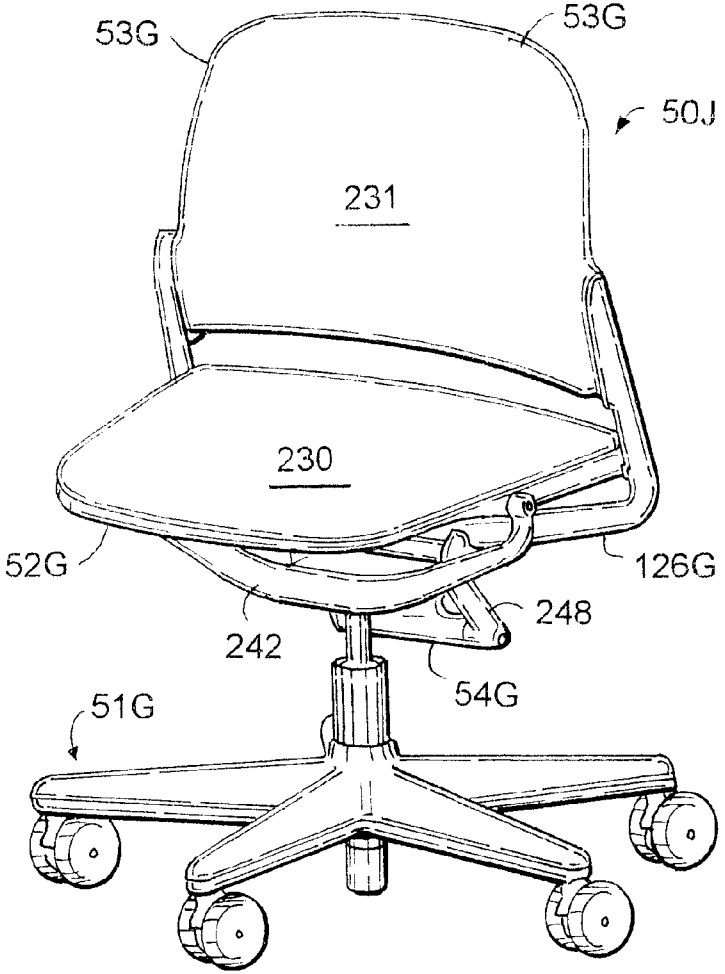
FIG. 60 is a perspective view of a chair similar to FIG. 51 but with seat and back cushions and no armrests.

The chair 50J (FIG. 60) is a perspective view of a chair similar to FIG. 51 but with seat and back cushions 230 and 231 and no armrests.

Figures 61, 62, 63:
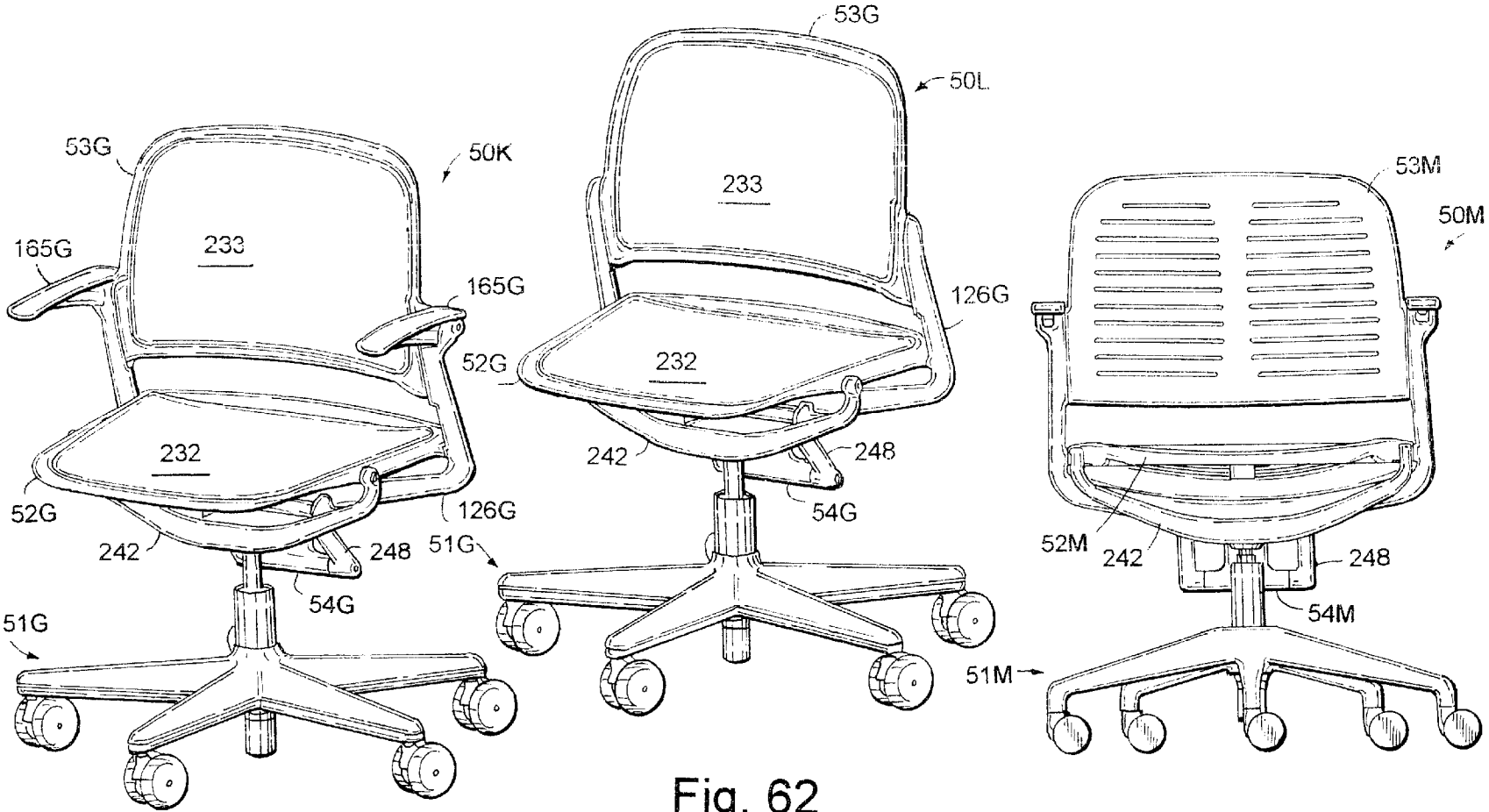
FIG. 61 is a perspective view of a chair similar to FIG. 51 with seat and back cushions and armrests.
FIG. 62 is a perspective view of a chair similar to FIG. 51 with seat and back cushions but without armrests.
FIG. 63 is a front view of a chair similar to the chair shown in FIG. 52 but having a modified base.

The chair 50K (FIG. 61) is a perspective view of a chair similar to FIG. 51 with smaller-cut seat and back cushions 232 and 233 and pivotable armrests 126G.

The chair 50L (FIG. 62) is a perspective view of a chair similar to FIG. 51, with smaller-cut seat and back cushions 232 and 233 but no armrests.

The chair 50M (FIG. 63) is a perspective view of a chair similar to FIG. 51, with a modified base subassembly 51M.

In the foregoing description, it will be readily appreciated by persons skilled in the art that modifications may be made to the invention without departing from the concepts disclosed herein. For example, it is specifically contemplated that the present concepts can be incorporated into a tandem seating arrangement. Such modifications are to be considered as included in the following claims, unless these claims by their language expressly state otherwise.

The invention claimed is:

1. A chair comprising:

a base subassembly including a vertically adjustable post;

a seat pivotally supported atop the post at a seat pivot;

a reclineable back pivoted to the seat at a back pivot;

a link having upwardly-directed sections pivoted to a lower portion of the back at a top link pivot and a downwardly-directed section pivoted to an upper rear portion of the base rearward of the post at a bottom link pivot; and the base subassembly, the seat, the back, and the link being pivoted together to form a four-bar linkage arrangement with at least one of the pivots including a torsion biasing device for biasing the four-bar linkage arrangement to bias the back toward an upright position.

2. The chair defined in claim 1, wherein the back includes a back shell and at least one lever fixed to the back shell.

3. The chair defined in claim 2, wherein the at least one lever is U-shaped.

4. The chair defined in claim 1, wherein the base subassembly includes castors.

5. The chair defined in claim 1, wherein the base subassembly includes a hub, radially extending legs attached to the hub, and a center post extending from the hub upwardly, and a top frame member engaging a top of the center post and operably supporting the seat.

6. The chair defined in claim 1, wherein one of the base subassembly, the seat and the back include a structural component that is made of polymeric material and is tubular.

7. The chair defined in claim 6, wherein the structural component is a gas-assisted molded part and has an elongated hollow core.

8. The chair defined in claim 1, wherein the back includes a perimeter section that is tubular and a center section that is a sheet-like panel integrally molded to the perimeter section.

9. The chair defined in claim 1, wherein the seat includes a perimeter section that is tubular and a center section that is a sheet-like panel integrally molded to the perimeter section.

10. The chair defined in claim 1, including armrests pivoted to one of the back, the seat and the base subassembly, each armrest being operably supported for movement to a use position generally above an associated edge of the seat for supporting a seated user's forearm, and for movement to a storage position that is remote from the associated edge of the seat, such that the edges of the seat are open and unobstructed for a seated user to enter the seat from a selected one of the edges of the seat.

11. The chair defined in claim 1, including an armrest and wherein the back includes armrest-supporting structure pivotally supporting the armrest for movement between a horizontal use position and a raised storage position, the armrest-supporting structure positioning the armrest completely behind a front surface of an edge section of the back, when the armrest is in the storage position, at a location where the armrest does not interfere with side access to the seat.

12. The chair defined in claim 11, wherein the armrest-supporting structure defines a pivot for the armrest that is located behind the front surface of the edge section of the back when the armrest is in the raised storage position.

13. The chair defined in claim 1, including cushions releasably attached to one of the seat and the base subassembly.

14. A seating unit comprising:

a base subassembly;

a seat pivotally supported atop the base subassembly at a seat pivot;

a reclineable back pivoted to the seat at a back pivot;

a link having upwardly-directed sections pivoted to a lower portion of the back at a top link pivot and a downwardly-directed section pivoted to an upper rear portion of the base subassembly rearward of a center of the base subassembly at a bottom link pivot;

the base subassembly, the seat, the back, and the link being pivoted together to form a four-bar linkage arrangement; the seat pivot, the back pivot, the top link pivot, and the bottom link pivot each being spaced-apart when viewed from a position beside the seating unit.

15. The seating unit defined in claim 14, wherein the back includes a back shell having a perimeter section that has the tubular structural section therein and further having a center section that is a sheet-like panel integrally molded to the perimeter section.

16. The seating unit defined in claim 15, wherein the back shell is one-piece and gas-injected molded.

17. The seating unit defined in claim 16, including a cushion removably attached to the back shell.

18. The seating unit defined in claim 14, wherein the seat includes a seat shell having a perimeter section that has the tubular structural section therein and further having a center section that is a sheet-like panel integrally molded to the perimeter section.

19. The seating unit defined in claim 18, including a cushion removably attached to the seat shell.

20. A seating unit comprising:

a base subassembly;

a seat pivotally supported atop the base assembly at a seat pivot;

a reclineable back pivoted to the seat at a back pivot;

a link having upwardly-directed sections pivoted to a lower portion of the back at a top link pivot and a downwardly-directed section pivoted to an upper rear portion of the base rearward of a center of the base subassembly at a bottom link pivot; and the base subassembly, the seat, the back, and the link being pivoted together to form a four-bar linkage arrangement with at least one of the pivots including a torsion biasing device for biasing the four-bar linkage arrangement to bias the back toward an upright position; the seat pivot, the back pivot, the top link pivot, and the bottom link pivot each being spaced-apart.

21. A seating unit comprising:

a base subassembly;

a seat pivotally supported by the base subassembly at a seat pivot;

a reclineable back pivoted to the seat at a back pivot;

a link having upwardly-directed sections pivoted to a lower portion of the back at a first pivot pin defining a top link pivot and a downwardly-directed section pivoted to an upper rear portion of the base subassembly at a second pivot pin defining a bottom link pivot; and the base subassembly, the seat, the back, and the link being pivoted together to form a four-bar linkage arrangement with at least one of the pivots including a torsion biasing device for biasing the four-bar linkage arrangement to bias the back toward an upright position; the top link pivot, the bottom link pivot, and the back pivot being vertically spaced-apart and also each being located rearward of the seat pivot.

* * * * *